US010240836B2

(12) United States Patent
Wallace et al.

(10) Patent No.: US 10,240,836 B2
(45) Date of Patent: Mar. 26, 2019

(54) ENERGY MANAGEMENT FOR REFRIGERATION SYSTEMS

(71) Applicant: Emerson Climate Technologies Retail Solutions, Inc., Kennesaw, GA (US)

(72) Inventors: John Wallace, Acworth, GA (US); Franklin Beltran, Acworth, GA (US); Frank S. Wallis, Sidney, OH (US); Keith Bertie, Doncaster (GB); Paul L. Fullenkamp, Versailles, OH (US)

(73) Assignee: Emerson Climate Technologies Retail Solutions, Inc., Kennesaw, GA (US)

( * ) Notice: Subject to any disclaimer, the term of this patent is extended or adjusted under 35 U.S.C. 154(b) by 30 days.

(21) Appl. No.: 15/197,121

(22) Filed: Jun. 29, 2016

(65) Prior Publication Data

US 2017/0089625 A1 Mar. 30, 2017

Related U.S. Application Data

(60) Provisional application No. 62/186,791, filed on Jun. 30, 2015.

(51) Int. Cl.

| | |
|---|---|
| ***F25B 49/02*** | (2006.01) |
| ***F25B 31/00*** | (2006.01) |
| ***F25B 5/02*** | (2006.01) |

(52) U.S. Cl.

CPC ..... *F25B 49/02* (2013.01); *F25B 5/02* (2013.01); *F25B 31/00* (2013.01); *F25B 49/022* (2013.01);

(Continued)

(58) Field of Classification Search

CPC ..... F25B 49/02; F25B 5/02; F25B 49/027; F25B 2700/171; F25B 2341/0661; F25B 2700/21152

See application file for complete search history.

(56) References Cited

U.S. PATENT DOCUMENTS 4,484,452 A 11/1984 Houser, Jr.
4,829,779 A 5/1989 Munson et al.

(Continued)

FOREIGN PATENT DOCUMENTS

JP H1089744 A * 4/1998
JP 2005090787 A * 4/2005

(Continued)

OTHER PUBLICATIONS

Urushibata et al., Number of Operating Set Control Method of Air Conditioner and Device . . . , Apr. 10, 1998, JPH1089744A, Whole Document.*

(Continued)

*Primary Examiner* — Larry L Furdge
(74) *Attorney, Agent, or Firm* — Harness, Dickey & Pierce, P.L.C.

(57) ABSTRACT

A system and method are provided including a system controller for a refrigeration or HVAC system having a compressor rack with a compressor and a condensing unit with a condenser fan. The system controller monitors and controls operation of the refrigeration or HVAC system. A rack controller monitors and controls operation of the compressor rack and determines compressor rack power consumption data. A condensing unit controller monitors and controls operation of the condensing unit and determines condensing unit power consumption data. The system controller receives the compressor rack power consumption data and the condensing unit power consumption data, determines a total power consumption of the refrigeration or HVAC system, determines a predicted power consumption or a benchmark power consumption for the refrigeration system, compares the total power consumption with the predicted power consumption or the benchmark power consumption, and generates an alert based on the comparison.

20 Claims, 10 Drawing Sheets

(52) U.S. Cl.
CPC .... *F25B 49/027* (2013.01); *F25B 2341/0661* (2013.01); *F25B 2400/075* (2013.01); *F25B 2400/22* (2013.01); *F25B 2600/0251* (2013.01); *F25B 2600/111* (2013.01); *F25B 2700/15* (2013.01); *F25B 2700/151* (2013.01); *F25B 2700/171* (2013.01); *F25B 2700/172* (2013.01); *F25B 2700/193* (2013.01); *F25B 2700/1931* (2013.01); *F25B 2700/1933* (2013.01); *F25B 2700/21152* (2013.01)

(56) References Cited

U.S. PATENT DOCUMENTS

| | | | | |
|---|---|---|---|---|
| 6,155,062 | A * | 12/2000 | Santarnecchi | B64D 13/08 62/158 |
| 6,318,101 | B1 | 11/2001 | Pham et al. | |
| 6,321,543 | B1 | 11/2001 | Said et al. | |
| 6,578,373 | B1 | 6/2003 | Barbier | |
| 6,711,911 | B1 | 3/2004 | Grabon et al. | |
| 7,752,854 | B2 | 7/2010 | Singh et al. | |
| 7,845,179 | B2 | 12/2010 | Singh et al. | |
| 9,194,393 | B2 | 11/2015 | Pham | |
| 2003/0037555 | A1 | 2/2003 | Street et al. | |
| 2005/0235664 | A1 | 10/2005 | Pham | |
| 2006/0117766 | A1 | 6/2006 | Singh et al. | |
| 2006/0130501 | A1* | 6/2006 | Singh | F25B 49/027 62/183 |
| 2007/0089440 | A1 | 4/2007 | Singh et al. | |
| 2009/0077983 | A1 | 3/2009 | Singh et al. | |
| 2009/0225479 | A1 | 9/2009 | Jayanth et al. | |
| 2010/0138190 | A1 | 6/2010 | McConnell et al. | |
| 2010/0175400 | A1 | 7/2010 | Kasahara | |
| 2010/0179703 | A1 | 7/2010 | Singh et al. | |
| 2010/0212343 | A1* | 8/2010 | Swofford | A47F 3/0447 62/248 |
| 2011/0167852 | A1* | 7/2011 | Kawaai | F25B 49/02 62/228.1 |
| 2011/0238232 | A1* | 9/2011 | Tomita | H02J 3/32 700/291 |
| 2012/0060529 | A1 | 3/2012 | Singh et al. | |
| 2012/0227427 | A1 | 9/2012 | Liu et al. | |
| 2013/0055742 | A1* | 3/2013 | Ouchi | F25D 21/002 62/155 |
| 2013/0272840 | A1* | 10/2013 | Fujioka | F04D 27/00 415/1 |
| 2014/0033746 | A1 | 2/2014 | McSweeney | |
| 2014/0208785 | A1 | 7/2014 | Wallace et al. | |
| 2014/0262134 | A1 | 9/2014 | Arensmeier et al. | |
| 2015/0032583 | A1 | 1/2015 | Mello et al. | |
| 2017/0089598 | A1 | 3/2017 | Wallace et al. | |

FOREIGN PATENT DOCUMENTS

| | | | |
|---|---|---|---|
| JP | 2011259656 | A * | 12/2011 |
| KR | 20100036345 | A | 4/2010 |
| WO | WO-2008010988 | A1 | 1/2008 |
| WO | WO-2014149174 | A1 | 9/2014 |

OTHER PUBLICATIONS

Mukai, Control Device and Method or Air Conditioner, Apr. 7, 2005, JP2005090787A, Whole Document.*

Nakayama et al., Energy Management Apparatus, Energy Management Method and Energy Management Program, Dec. 22, 2011, HO2011259656A, Whole Document.*

International Search Report regarding International Application No. PCT/US2016/040488, dated Oct. 18, 2016.

Written Opinion of the International Searching Authority regarding International Application No. PCT/US2016/040488, dated Oct. 18, 2016.

International Search Report regarding International Application No. PCT/US2017/056771 dated Jan. 19, 2018.

Written Opinion of the International Searching Authority regarding International Application No. PCT/US2017/056771 dated Jan. 19, 2018.

Written Opinion of the International Searching Authority regarding International Application No. PCT/US2016/040468, dated Oct. 25, 2016.

International Search Report regarding International Application No. PCT/US2016/040468, dated Oct. 25, 2016.

Non-Final Office Action regarding U.S. Appl. No. 15/819,742 dated Sep. 10, 2018.

* cited by examiner

ENERGY MANAGEMENT FOR REFRIGERATION SYSTEMS

CROSS-REFERENCE TO RELATED APPLICATIONS

This application claims the benefit of U.S. Provisional Application No. 62/186,791, filed on Jun. 30, 2015. The entire disclosures of the applications referenced above are incorporated herein by reference.

FIELD

The present disclosure relates to refrigeration systems and, more particularly, to energy management for refrigeration systems.

BACKGROUND

The background description provided herein is for the purpose of generally presenting the context of the disclosure. Work of the presently named inventor(s), to the extent it is described in this background section, as well as aspects of the description that may not otherwise qualify as prior art at the time of filing, are neither expressly nor impliedly admitted as prior art against the present disclosure.

Refrigeration systems are an essential part of many commercial building and dwellings. For example, food retailers may rely on refrigeration systems to ensure the quality and safety of food products. Many other businesses may have products or materials that must be refrigerated or maintained at a lowered temperature. HVAC systems allow people to remain comfortable where they shop, work or live.

Refrigeration systems, however, can require a significant amount of energy to operate. The cost for energy required to operate refrigeration systems can be significant. As such, it may be beneficial for refrigeration system users to closely monitor the performance and energy consumption of the refrigeration systems to maximize efficiency and reduce operational costs. Refrigeration system users may lack the expertise to accurately analyze system performance and energy consumption data to effectively manage energy consumption costs for the refrigeration system.

SUMMARY

This section provides a general summary of the disclosure, and is not a comprehensive disclosure of its full scope or all of its features.

A system is provided and includes a system controller for a refrigeration or HVAC system having a compressor rack with at least one compressor and a condensing unit with at least one condenser fan. The system controller monitors and controls operation of the refrigeration or HVAC system. The system also includes a rack controller in communication with the system controller, the rack controller monitoring and controlling operation of the compressor rack and determining compressor rack power consumption data. The system also includes a condensing unit controller in communication with the system controller. The condensing unit controller monitors and controls operation of the condensing unit and determining condensing unit power consumption data. The system controller receives the compressor rack power consumption data and the condensing unit power consumption data, determines a total power consumption of the refrigeration or HVAC system based on the compressor rack power consumption data and the condensing unit power consumption data, determines at least one of a predicted power consumption and a benchmark power consumption for the refrigeration system, compares the total power consumption with at least one of the predicted power consumption and the benchmark power consumption, and generates an alert based on the comparison.

In other features, the system controller can receive performance coefficients for the refrigeration or HVAC system and determine the predicted power consumption based on the performance coefficients and on operational data for the refrigeration or HVAC system.

In other features, the system controller can monitor power consumption data of the refrigeration or HVAC system over an initialization period and determined the benchmark power consumption based on the monitored power consumption data for the initialization period.

A method is provided that includes monitoring and controlling, with a system controller, operation of a refrigeration or HVAC system having a compressor rack with at least one compressor and a condensing unit with at least one condenser fan. The method also includes monitoring and controller, with a rack controller in communication with the system controller, operation of the compressor. The method also includes determining, with the rack controller, compressor rack power consumption data for the compressor rack. The method also includes monitoring and controller, with a condensing unit controller in communication with the system controller, operation of the condensing unit. The method also includes determining, with the condensing unit controller, power consumption data for the condensing unit. The method also includes receiving, with the system controller, the compressor rack power consumption data and the condensing unit power consumption data. The method also includes determining, with the system controller, a total power consumption of the refrigeration or HVAC system based on the compressor rack power consumption data and the condensing unit power consumption data. The method also includes determining, with the system controller, at least one of a predicted power consumption and a benchmark power consumption for the refrigeration system. The method also includes comparing, with the system controller, the total power consumption with at least one of the predicted power consumption and the benchmark power consumption. The method also includes generating, with the system controller, an alert based on the comparison.

In other features, the method can include receiving, with the system controller, performance coefficients for the refrigeration or HVAC system.

In other features, the method can include determining, with the system controller, the predicted power consumption based on the performance coefficients and on operational data for the refrigeration or HVAC system.

Another system is provided and includes a controller for a refrigeration or HVAC system having a compressor rack with at least one compressor and a condensing unit with at least one condenser fan, the system controller monitoring and controlling operation of the refrigeration or HVAC system. The controller determines compressor rack power consumption data corresponding to a power consumption of the compressor rack, determines condensing unit power consumption data corresponding to a power consumption of the condensing unit, determines a total power consumption of the refrigeration or HVAC system based on the compressor rack power consumption data and the condensing unit power consumption data, determines at least one of a predicted power consumption and a benchmark power consumption for the refrigeration system, compares the total power consumption with at least one of the predicted power consumption and the benchmark power consumption, and generates an alert based on the comparison.

In other features, the controller receives performance coefficients for the refrigeration or HVAC system and determines the predicted power consumption based on the performance coefficients and on operational data for the refrigeration or HVAC system.

In other features, the controller monitors power consumption data of the refrigeration or HVAC system over an initialization period and determines the benchmark power consumption based on the monitored power consumption data for the initialization period.

Another method is provided and includes monitoring and controlling, with a controller, operation of a refrigeration or HVAC system having a compressor rack with at least one compressor and a condensing unit with at least one condenser fan. The method also includes monitoring and controller, with the system controller, operation of the compressor. The method also includes determining, with the controller, compressor rack power consumption data for the compressor rack. The method also includes monitoring and controller, with the system controller, operation of the condensing unit. The method also includes determining, with the controller, power consumption data for the condensing unit. The method also includes determining, with the controller, a total power consumption of the refrigeration or HVAC system based on the compressor rack power consumption data and the condensing unit power consumption data. The method also includes determining, with the controller, at least one of a predicted power consumption and a benchmark power consumption for the refrigeration system. The method also includes comparing, with the controller, the total power consumption with at least one of the predicted power consumption and the benchmark power consumption. The method also includes generating, with the controller, an alert based on the comparison.

In other features, the method also includes receiving, with the controller, performance coefficients for the refrigeration or HVAC system and determining, with the controller, the predicted power consumption based on the performance coefficients and on operational data for the refrigeration or HVAC system.

In other features, the method also includes monitoring, with the controller, power consumption data of the refrigeration or HVAC system over an initialization period and determining, with the controller, the benchmark power consumption based on the monitored power consumption data for the initialization period.

In other features, the method can include monitoring, with the system controller, power consumption data of the refrigeration or HVAC system over an initialization period and determining, with the system controller, the benchmark power consumption based on the monitored power consumption data for the initialization period.

Another system is provided and includes a system controller for a refrigeration or HVAC system having a compressor rack with at least one compressor and a condensing unit with at least one condenser fan, the system controller monitoring and controlling operation of the refrigeration or HVAC system. The system also includes a rack controller in communication with the system controller, the rack controller monitoring and controlling operation of the compressor rack and determining compressor rack power consumption data. The system also includes a condensing unit controller in communication with the system controller, the condensing unit controller monitoring and controlling operation of the condensing unit and determining condensing unit power consumption data. The system controller receives the compressor rack power consumption data and the condensing unit power consumption data, determines a total power consumption of the refrigeration or HVAC system based on the compressor rack power consumption data and the condensing unit power consumption data, and modifies operation of at least one of the compressor rack and the condensing unit to minimize the total power consumption of the refrigeration or HVAC system.

Another method is provided and includes monitoring and controlling, with a system controller, a refrigeration or HVAC system having a compressor rack with at least one compressor and a condensing unit with at least one condenser fan. The method also includes monitoring and controller, with a rack controller in communication with the system controller, operation of the compressor rack. The method also includes determining, with the rack controller, compressor rack power consumption data. The method also includes monitoring and controller, with a condensing unit controller in communication with the system controller, operation of the condensing unit. The method also includes determining, with the condensing unit controller, condensing unit power consumption data. The method also includes receiving, with the system controller, the compressor rack power consumption data and the condensing unit power consumption data. The method also includes determining, with the system controller, a total power consumption of the refrigeration or HVAC system based on the compressor rack power consumption data and the condensing unit power consumption data. The method also includes modifying, with the system controller, operation of at least one of the compressor rack and the condensing unit to minimize the total power consumption of the refrigeration or HVAC system.

Another system is provided and includes a system controller for a refrigeration or HVAC system having a compressor rack with a plurality of compressors and a condensing unit with a plurality of condenser fans, the system controller monitoring and controlling operation of the refrigeration or HVAC system. The system also includes a rack controller in communication with the system controller, the rack controller monitoring and controlling operation of the compressor rack. The system also includes a condensing unit controller in communication with the system controller, the condensing unit controller monitoring and controlling operation of the condensing unit. The system controller determines a startup power demand for each compressor of the plurality of compressors and each condenser fan of the plurality of condenser fans and determines a startup sequence to limit peak power demand during a startup operation to be below a predetermined power threshold.

Another method is provided and includes monitoring and controlling, with a system controller, a refrigeration or HVAC system having a compressor rack with a plurality of compressors and a condensing unit with a plurality of condenser fans. The method also includes monitoring and controller, with a rack controller in communication with the system controller, operation of the compressor rack. The method also includes monitoring and controller, with a condensing unit controller in communication with the system controller, operation of the condensing unit. The method also includes determining, with the system controller, a startup power demand for each compressor of the plurality of compressors and each condenser fan of the plurality of condenser fans. The method also includes determining, with the system controller, a startup sequence to limit peak power demand during a startup operation to be below a predetermined power threshold.

Another system is provided and includes a system controller for a refrigeration or HVAC system having a compressor rack with a plurality of compressors and a condensing unit with a plurality of condenser fans, the system controller monitoring and controlling operation of the refrigeration or HVAC system. The system also includes a rack controller in communication with the system controller, the rack controller monitoring and controlling operation of the compressor rack. The system also includes a condensing unit controller in communication with the system controller, the condensing unit controller monitoring and controlling operation of the condensing unit. The system controller receives a signal corresponding to limiting power consumption and selects at least one compressor from the plurality of compressors and at least one condenser fan from the plurality of condenser fans to operate to maximize refrigeration capacity while maintaining a total power consumption below a power threshold associated with the signal.

In other features, the signal can be received from a utility as a demand shed signal and wherein the power threshold is associated with the demand shed signal.

In other features, the signal can be received from an onsite power generation device and wherein the power threshold corresponds to an amount of power generated by the onsite power generation device.

In other features, the signal can be received from an onsite power generation device and wherein the power threshold corresponds to a predicted amount of power to be generated by the onsite power generation device.

Another method is provided and includes monitoring and controlling, with a system controller, a refrigeration or HVAC system having a compressor rack with a plurality of compressors and a condensing unit with a plurality of condenser fans. The method also includes monitoring and controller, with a rack controller in communication with the system controller, operation of the compressor rack. The method also includes monitoring and controller, with a condensing unit controller in communication with the system controller, operation of the condensing unit. The method also includes receiving, with the system controller, a signal corresponding to limiting power consumption. The method also includes selecting, with the system controller, at least one compressor from the plurality of compressors and at least one condenser fan from the plurality of condenser fans to operate to maximize refrigeration capacity while maintaining a total power consumption below a power threshold associated with the signal.

In other features, the signal can be received from a utility as a demand shed signal and wherein the power threshold is associated with the demand shed signal.

In other features, the signal can be received from an onsite power generation device and wherein the power threshold corresponds to an amount of power generated by the onsite power generation device.

In other features, the signal can be received from an on-site power generation device and wherein the power threshold corresponds to a predicted amount of power to be generated by the on-site power generation device.

Another system is provided and includes a system controller for a refrigeration or HVAC system having a compressor rack with at least one compressor and a condensing unit with at least one condenser fan, the system controller monitoring and controlling operation of the refrigeration or HVAC system. The system also includes a rack controller in communication with the system controller, the rack controller monitoring and controlling operation of the compressor rack and determining compressor rack power consumption data. The system also includes a condensing unit controller in communication with the system controller, the condensing unit controller monitoring and controlling operation of the condensing unit and determining condensing unit power consumption data. The system controller receives the compressor rack power consumption data and the condensing unit power consumption data, receives forecast weather data for a future time period, determines a predicted total power consumption of the refrigeration or HVAC system based on the forecast weather data, compares the predicted total power consumption of the refrigeration or HVAC system with a predetermined power threshold, and generates an alert when the predicted total power consumption is greater than the predetermined power threshold.

In other features, the system controller modifies operation of the refrigeration system prior to the future time period to reduce power consumption of the refrigeration system during the future time period.

Another method is provided and includes monitoring and controlling, with a system controller, operation of a refrigeration or HVAC system having a compressor rack with at least one compressor and a condensing unit with at least one condenser fan. The method also includes monitoring and controller, with a rack controller in communication with the system controller, operation of the compressor. The method also includes determining, with the rack controller, compressor rack power consumption data for the compressor rack. The method also includes monitoring and controller, with a condensing unit controller in communication with the system controller, operation of the condensing unit. The method also includes determining, with the condensing unit controller, power consumption data for the condensing unit. The method also includes receiving, with the system controller, the compressor rack power consumption data and the condensing unit power consumption data. The method also includes receiving, with the system controller, forecast weather data for a future time period. The method also includes determining, with the system controller, a predicted total power consumption of the refrigeration or HVAC system based on the forecast weather data. The method also includes comparing, with the system controller, the predicted total power consumption of the refrigeration or HVAC system with a predetermined power threshold. The method also includes generating, with the system controller, an alert when the predicted total power consumption is greater than the predetermined power threshold.

In other features, the method can also include modifying, with the system controller, operation of the refrigeration system prior to the future time period to reduce power consumption of the refrigeration system during the future time period.

Another system is provided and includes a monitoring device for a refrigeration or HVAC system having a compressor rack with at least one compressor and a condensing unit with at least one condenser fan, the monitoring device monitoring and controlling operation of the refrigeration or HVAC system. The system also includes a rack controller in communication with the monitoring device, the rack controller monitoring and controlling operation of the compressor rack. The system also includes a condensing unit controller in communication with the monitoring device, the condensing unit controller monitoring and controlling operation of the condensing unit. The monitoring device monitors operational data, including at least one of a suction pressure, a discharge pressure, a suction temperature, a discharge temperature, a liquid temperature, and power consumption data for the HVAC system, and determines at least one of a coefficient of performance, a capacity, a power input, an isentropic efficiency percentage, and a mass flow rate based on the monitored operational data.

Another method is provided and includes monitoring and controlling, with a monitoring device, operation of a refrigeration or HVAC system having a compressor rack with at least one compressor and a condensing unit with at least one condenser fan. The method also includes monitoring and controller, with a rack controller in communication with the monitoring device, operation of the compressor rack. The method also includes monitoring and controlling, with a condensing unit controller in communication with the monitoring device, operation of the condensing unit. The method also includes monitoring, with the monitoring device, operational data, including at least one of a suction pressure, a discharge pressure, a suction temperature, a discharge temperature, a liquid temperature, and power consumption data for the HVAC system. The method also includes determining, with the monitoring device, at least one of a coefficient of performance, a capacity, a power input, an isentropic efficiency percentage, and a mass flow rate based on the monitored operational data.

Another system is provided and includes a controller for a refrigeration or HVAC system having a compressor rack with at least one compressor. The controller includes a monitoring module configured to monitor power consumption of a compressor in the compressor rack based on data received from a power meter associated with the compressor, a supply voltage for the compressor, or amperage of the compressor. The system further includes a tracking module configured to track performance of the compressor based on the power consumption of the compressor.

In other features, the monitoring module further includes a voltage determining module, a power factor module, and a power consumption module. The voltage determining module is configured to determine the supply voltage for the compressor based on power supplied to the compressor rack and a number of compressors in the compressor rack. The power factor module is configured to adjust a power factor for the compressor based on the supply voltage and a voltage rating of the compressor. The power consumption module is configured to determine the power consumption of the compressor based on the adjusted power factor, the supply voltage for the compressor, and the amperage of the compressor.

In other features, the monitoring module further includes a power consumption module and an error correction module. The power consumption module is configured to estimate the power consumption of each compressor in the compressor rack based on the amperage of the compressor, a voltage rating of the compressor, and a power factor rating of the compressor. The error correction module is configured to determine an error correction factor to apply to the estimated power consumption of each compressor such that a sum of power consumption values of each compressor and other loads of the refrigeration or HVAC system equals a measured aggregate power consumption of the compressor rack.

Another system is provided and includes a controller for a refrigeration or HVAC system having a compressor rack with at least one compressor. The controller communicates with a performance tracking module configured to track performance of a compressor in the compressor rack. In response to rated performance data for the compressor being unavailable, the performance tracking module is configured to generate baseline data for the compressor and to assess the performance of the compressor by comparing operational data of the compressor to the baseline data for the compressor. In response to the rated performance data for the compressor being available, the performance tracking module is configured to assess the performance of the compressor by comparing the operational data of the compressor to the rated performance data for the compressor.

In other features, the controller includes the performance tracking module.

In other features, a remote controller includes the performance tracking module.

In other features, the performance tracking module includes a baseline data module and a monitoring module. The baseline data module is configured to generate the baseline data for the compressor based on data received from the compressor immediately following installation of compressor. The monitoring module is configured to assess the performance of the compressor by comparing the baseline data to the operational data of the compressor obtained subsequent to developing the baseline data.

In other features, the performance tracking module includes a regression-based monitoring module configured to perform a regression analysis on the rated performance data and the data obtained from the compressor during operation, and assess the performance of the compressor based on the regression analysis.

In other features, the regression-based monitoring module includes a benchmark generating module and an analyzing module. The benchmark generating module is configured to generate a benchmark polynomial and a benchmark hull. The analyzing module is configured to analyze data obtained from the compressor during operation using the benchmark polynomial and the benchmark hull and to assess the performance of the compressor based on the analysis.

In other features, the system further includes an optimizing module configured to select only statistically significant variables affecting a selected one of the rated performance data and to eliminate statistically insignificant variables, and to optimize the benchmark polynomial using the selected variables.

In other features, the system further includes an outlier detecting module configured to detect outliers in the data obtained from the compressor during operation and to remove outliers with largest deviation.

In other features, the system further includes a comparing module configured to compare the benchmark polynomial and the benchmark hull with historical benchmark polynomial and hull data and to assess the performance of the compressor based on the comparison.

Another method is provided and includes controlling, with a controller, a refrigeration or HVAC system having a compressor rack with at least one compressor. The method further includes monitoring, with a monitoring module, power consumption of a compressor in the compressor rack based on data received from a power meter associated with the compressor, a supply voltage for the compressor, or amperage of the compressor. The method further includes tracking, with a tracking module, performance of the compressor based on the power consumption of the compressor.

In other features, the monitoring the power consumption of the compressor in the compressor rack further includes the following: determining, with a voltage determining module, the supply voltage for the compressor based on power supplied to the compressor rack and a number of compressors in the compressor rack; adjusting, with a power factor module, a power factor for the compressor based on the supply voltage and a voltage rating of the compressor; and determining, with a power consumption module, the power consumption of the compressor based on the adjusted power factor, the supply voltage for the compressor, and the amperage of the compressor.

In other features, the method further includes estimating, with a power consumption module, the power consumption of each compressor in the compressor rack based on the amperage of the compressor, a voltage rating of the compressor, and a power factor rating of the compressor. The method further includes determining, with an error correction module, an error correction factor to apply to the estimated power consumption of each compressor such that a sum of power consumption values of each compressor and other loads of the refrigeration or HVAC system equals a measured aggregate power consumption of the compressor rack.

Another method is provided and includes controlling, with a controller, a refrigeration or HVAC system having a compressor rack with at least one compressor. The method further includes communicating with a performance tracking module configured to track performance of a compressor in the compressor rack. The method further includes, in response to rated performance data for the compressor being unavailable, generating, with the performance tracking module, baseline data for the compressor and assessing the performance of the compressor by comparing operational data of the compressor to the baseline data for the compressor. The method further includes, in response to the rated performance data for the compressor being available, assessing, with the performance tracking module, the performance of the compressor by comparing the operational data of the compressor to the rated performance data for the compressor.

In other features, the method further includes generating, with a baseline data module, the baseline data for the compressor based on data received from the compressor immediately following installation of compressor; and assessing, with a monitoring module, the performance of the compressor by comparing the baseline data to the operational data of the compressor obtained subsequent to developing the baseline data.

In other features, the method further includes performing, with a regression-based monitoring module, a regression analysis on the rated performance data and the data obtained from the compressor during operation; and assessing, with the regression-based monitoring module, the performance of the compressor based on the regression analysis.

In other features, the method further includes generating, with a benchmark generating module, a benchmark polynomial and a benchmark hull; and analyzing, with an analyzing module, data obtained from the compressor during operation using the benchmark polynomial and the benchmark hull and assessing the performance of the compressor based on the analysis.

In other features, the method further includes selecting, with an optimizing module, only statistically significant variables affecting a selected one of the rated performance data and eliminating statistically insignificant variables; and optimizing, with the optimizing module, the benchmark polynomial using the selected variables.

In other features, the method further includes detecting, with an outlier detecting module, outliers in the data obtained from the compressor during operation and removing outliers with largest deviation.

In other features, the method further includes comparing, with a comparing module, the benchmark polynomial and the benchmark hull with historical benchmark polynomial and hull data and assessing the performance of the compressor based on the comparison.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

In the drawings, reference numbers may be reused to identify similar and/or identical elements.

DETAILED DESCRIPTION

Example embodiments will now be described more fully with reference to the accompanying drawings.

Figure 1:
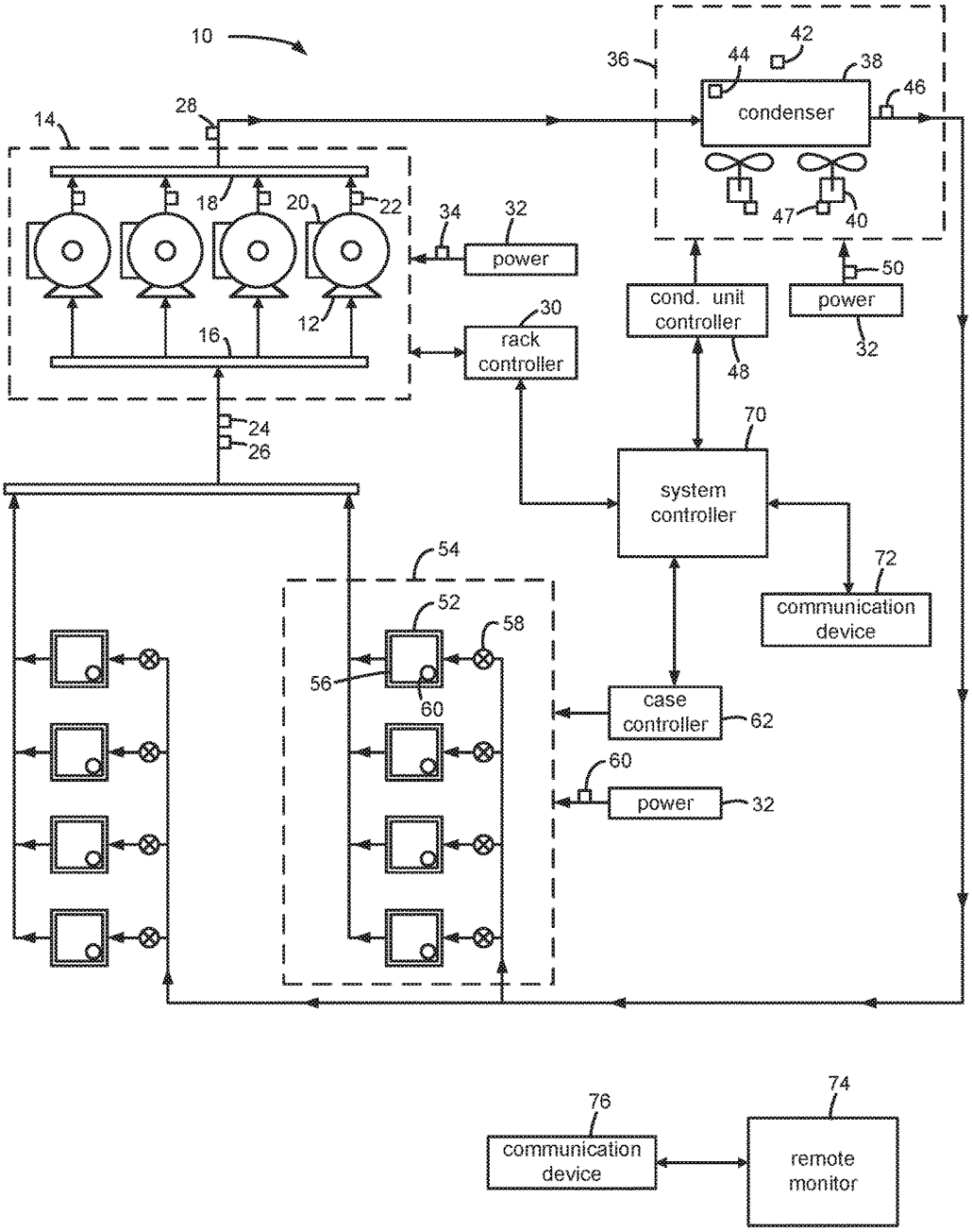
FIG. 1 is a block diagram of an example refrigeration system.

With reference to FIG. 1, an exemplary refrigeration system 10 is shown and includes a plurality of compressors 12 piped together in a compressor rack 14 with a common suction manifold 16 and a discharge header 18. While FIG. 1 shows an example refrigeration system 10, the teachings of the present disclosure also apply, for example, to HVAC systems.

Each compressor 12 has an associated compressor controller 20 that monitors and controls operation of the compressor 12. For example, the compressor controller 20 may monitor electric power, voltage, and/or current delivered to the compressor 12 with a power sensor, a voltage sensor, and/or a current sensor. Further, the compressor controller 20 may also monitor suction or discharge temperatures or pressures of the compressor 12 with suction or discharge temperature or pressure sensors. For example, a discharge outlet of each compressor 12 can include a respective discharge temperature sensor 22. A discharge pressure sensor can be used in addition to, or in place of, the discharge temperature sensor 22. An input to the suction manifold 16 can include both a suction pressure sensor 24 and a suction temperature sensor 26. Further, a discharge outlet of the discharge header 18 can include an associated discharge pressure sensor 28. A discharge temperature sensor can be used in addition to, or in place of, the discharge pressure sensor 28. As described in further detail below, the various sensors can be implemented for managing and monitoring energy consumption of the compressors 12 in the compressor rack 14.

A rack controller 30 may monitor and control operation of the compressor rack 14 via communication with each of the compressor controllers 20. For example, the rack controller 30 may instruct individual compressors 12 to turn on or turn off through communication with the compressor controllers 20. Additionally, the rack controller 30 may instruct variable capacity compressors to increase or decrease capacity through communication with the compressor controllers 20. In addition, the rack controller 30 may receive data indicating the electric power, voltage, and/or current delivered to each of the compressors 12 from the compressor controllers 20. Further, the rack controller 30 may also receive data indicating the suction or discharge temperatures or pressures of each of the compressors 12 from the compressor controllers 20. Additionally or alternatively, the rack controller 30 may communicate directly with the suction or discharge temperature or pressure sensors to receive such data. Additionally, the rack controller 30 may be in communication with other suction and discharge temperature and pressure sensors, including, for example, discharge pressure sensor 28, suction pressure sensor 24, and suction temperature sensor 26.

Electric power may be delivered to the compressor rack 14 from a power supply 32 for distribution to the individual compressors 12. A rack power sensor 34 may sense the amount of power delivered to the compressor rack 14. A current sensor or a voltage sensor may be used in place of or in addition to the power sensor 34. The rack controller 30 may communicate with the rack power sensor 34 and monitor the amount of power delivered to the compressor rack 14. Alternatively, the rack power sensor 34 may be omitted and the total power delivered to the compressor rack 14 may be determined based on the power data for the power delivered to each of the individual compressors 12 as determined by the compressor controllers 20.

The compressor rack 14 compresses refrigerant vapor that is delivered to a condensing unit 36 having a condenser 38 where the refrigerant vapor is liquefied at high pressure. Condenser fans 40 may enable improved heat transfer from the condenser 38. The condensing unit 36 can include an associated ambient temperature sensor 42, a condenser temperature sensor 44, and/or a condenser discharge pressure sensor 46. Each of the condenser fans 40 may include a condenser fan power sensor 47 that senses the amount of power delivered to each of the condenser fans 40. A current sensor or a voltage sensor may be used in place of or in addition to the condenser fan power sensor 47.

A condensing unit controller 48 may monitor and control operation of the condenser fans 40. For example, the condensing unit controller 48 may turn on or turn off individual condenser fans 40 and/or increase or decrease capacity of any variable speed condenser fans 40. In addition, the condensing unit controller 48 may receive data indicating the electric power delivered to each of the condenser fans 40 through communication with the condenser fan power sensors 47. Additionally, the condensing unit controller 48 may be in communication with the other condensing unit sensors, including, for example, the ambient temperature sensor 42, the condenser temperature sensor 44, and the condenser discharge pressure sensor 46.

Electric power may be delivered to the condensing unit 36 from the power supply 32 for distribution to the individual condenser fans 40. A condensing unit power sensor 50 may sense the amount of power delivered to the condensing unit 36. A current sensor or a voltage sensor may be used in place of or in addition to the condensing unit power sensor 50. The condensing unit controller 48 may communicate with the condensing unit power sensor 50 and monitor the amount of power delivered to the condensing unit 36.

The high-pressure liquid refrigerant from the condensing unit 36 may be delivered to refrigeration cases 52. For example, refrigeration cases 52 may include a group 54 of refrigeration cases 52. The refrigeration cases 52 may be refrigerated or frozen food cases at a grocery store, for example. Each refrigeration case 52 may include an evaporator 56 and an expansion valve 58 for controlling the superheat of the refrigerant and an evaporator temperature sensor 60. The refrigerant passes through the expansion valve 58 where a pressure drop causes the high pressure liquid refrigerant to achieve a lower pressure combination of liquid and vapor. As hot air from the refrigeration case 52 moves across the evaporator 56, the low pressure liquid turns into gas. The low pressure gas is then delivered back to the compressor rack 14, where the refrigeration cycle starts again.

A case controller 62 may monitor and control operation of the evaporators 56 and/or the expansion valves 58. For example, the case controller 62 may turn on or turn off evaporator fans of the evaporators 54 and/or increase or decrease capacity of any variable speed evaporator fans. The case controller 62 may be in communication with the evaporator temperature sensor 60 and receive evaporator temperature data.

Electric power may be delivered to the group 54 of refrigeration cases 52 from the power supply 32 for distribution to the individual condenser fans 40. A refrigeration case power sensor 60 may sense the amount of power delivered to the group 54 of refrigeration cases 52. A current sensor or a voltage sensor may be used in place of or in addition to the refrigeration case power sensor 60. The case controller 62 may communicate with the refrigeration case power sensor 60 and monitor the amount of power delivered to the group 54 of refrigeration cases 52.

As discussed above, while FIG. 1 shows an example refrigeration system 10, the teachings of the present disclosure also apply, for example, to HVAC systems, including, for example, air conditioning and heat pump systems. In the example of an HVAC system, the evaporators 56 would be installed in air handler units instead of in refrigeration cases 52.

A system controller 70 monitors and controls operation of the entire refrigeration system 10 through communication with each of the rack controller 30, condensing unit controller 48, and the case controller 62. Alternatively, the rack controller 30, condensing unit controller 48, and/or case controller 62 could be omitted and the system controller 70 could directly control the compressor rack 14, condensing unit 36, and/or group 54 of refrigeration cases 52. The system controller 70 can receive the operation data of the refrigeration system 10, as sensed by the various sensors, through communication with the rack controller 30, condensing unit controller 48, and/or case controller 62. For example, the system controller can receive data regarding the various temperatures and pressures of the system and regarding electric power, current, and/or voltage delivered to the various system components. Alternatively, some or all of the various sensors may be configured to communicate directly with the system controller. For example, the ambient temperature sensor 42 may communicate directly with the system controller 70 and provide ambient temperature data.

The system controller 70 may coordinate operation of the refrigeration system, for example, by increasing or decreasing capacity of various system components. For example, the system controller 70 may instruct the rack controller 30 to increase or decrease capacity by activating or deactivating a compressor 12 or by increasing or decreasing capacity of a variable capacity compressor 12. The system controller 70 may instruct the condensing unit controller 48 to increase or decrease condensing unit capacity by activating or deactivating a condenser fan 40 or by increasing or decreasing a speed of a variable speed condenser fan 40. The system controller 70 may instruct the case controller 62 to increase or decrease evaporator capacity by activating or deactivating an evaporator fan of an evaporator 56 or by increasing or decreasing a speed of a variable speed evaporator fan. The system controller 70 may include a computer-readable medium, such as a volatile or non-volatile memory, to store instructions executable by a processor to carry out the functionality described herein to monitor and control operation of the refrigeration system 10.

The system controller 70 may be, for example, an E2 RX refrigeration controller available from Emerson Climate Technologies Retail Solutions, Inc. of Kennesaw, Ga. If the system is an HVAC system instead of a refrigeration system, the system controller 70 may be, for example, an E2 BX HVAC and lighting controller also available from Emerson Climate Technologies Retail Solutions, Inc. of Kennesaw, Ga. Further, any other type of programmable controller that may be programmed with the functionality described in the present disclosure can also be used.

The system controller 70 may be in communication with a communication device 72. The communication device 72 may be, for example, a desktop computer, a laptop, a tablet, a smartphone or other computing device with communication/networking capabilities. The communication device 72 may communicate with the system controller 70 via a local area network at the facility location of the refrigeration system 10. The communication device 72 may also communicate with the system controller 70 via a wide area network, such as the internet.

The communication device 72 may communicate with the system controller 70 to receive and view operational data of the refrigeration system 10, including, for example, energy or performance data for the refrigeration system 10.

The system controller 70 may also communicate with a remote monitor 74 via, for example, a wide area network, such as the internet, or via phone lines, cellular, and/or satellite communication. The remote monitor 74 may communicate with multiple system controllers 70 associated with multiple refrigeration or HVAC systems. The remote monitor 74 may also be accessible to a communication device 76, such as a desktop computer, a laptop, a tablet, a smartphone or other computing device with communication/networking capabilities. The communication device 76 may communicate with the remote monitor 74 to receive and view operational data for one or more refrigeration or HVAC systems, including, for example, energy or performance data for the refrigeration or HVAC systems.

The system controller 70 can monitor the actual power consumption of the refrigeration system 10, including the compressor rack 14, the condensing unit 36, and the refrigeration cases 52, and compare the actual power consumption of the refrigeration system 10 with a predicted power consumption or with a benchmark power consumption for the refrigeration system 10.

Figure 2:
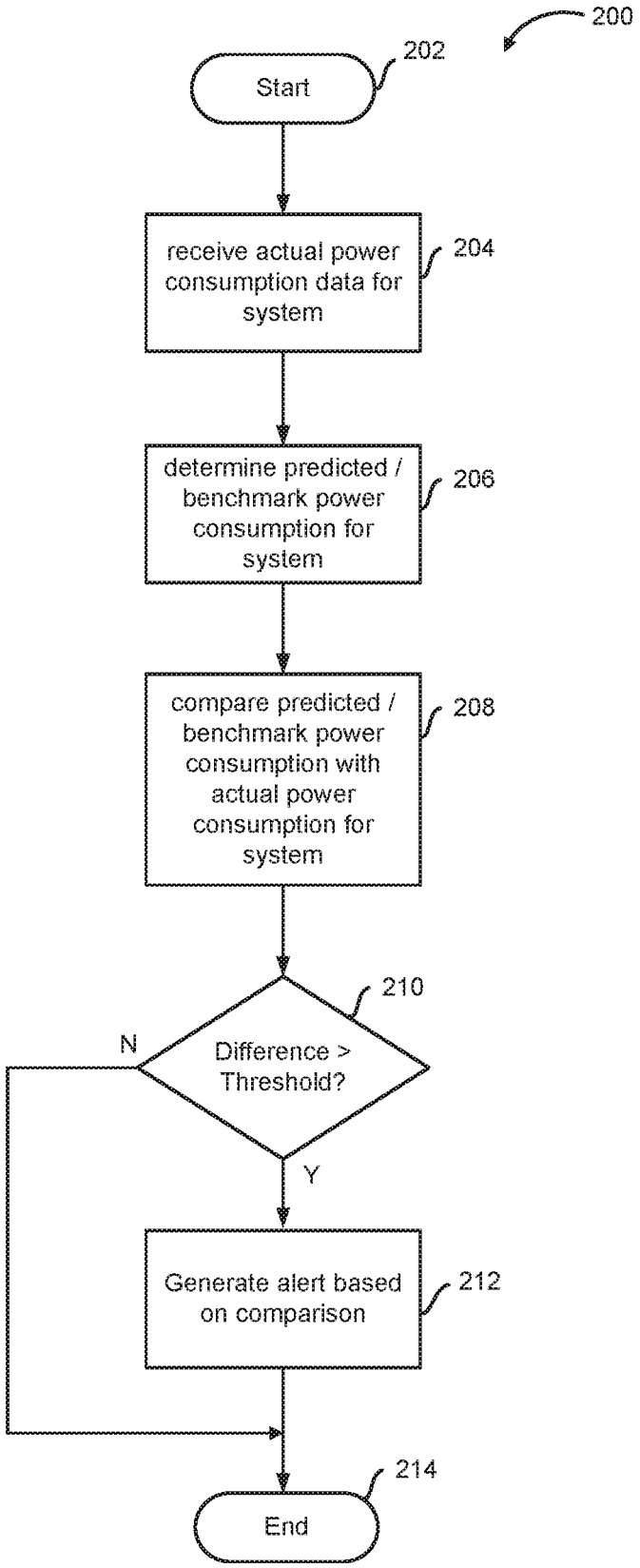
FIG. 2 is a flowchart of example operation in comparing actual power consumption with predicted or benchmark power consumption.

With reference to FIG. 2, a control algorithm 200 is shown for comparing actual power consumption with predicted power consumption or benchmark power consumption. The control algorithm 200 may be performed, for example, by the system controller 70 and starts at 202. At 204, the system controller 70 receives actual power consumption data for the refrigeration system 10. For example, as discussed above, the system controller 70 can receive power consumption data regarding the compressor rack 14, the condensing unit 36, and the group 54 of refrigeration cases 52 from the rack controller 30, the condensing unit controller 48, and the case controller 62. At 206, the system controller 70 determines predicted or benchmark power consumption for the system based on operational data for the refrigeration system 10. Further details for determining the predicted or benchmark power consumption for the system are discussed below with reference to FIGS. 3 and 4.

At 208, the system controller 70 compares the predicted or benchmark power consumption with the actual power consumption for the system. At 210, the system controller 70 determines whether the difference between the actual power consumption and the predicted or benchmark power consumption is greater than a predetermined threshold. At 210, when the difference is greater than the predetermined threshold, the system controller 70 can generate an alert. For example, the system controller 70 may communicate an alert to the communication device 72 or to the remote monitor 74 for subsequent communication to the communication device 76. At 210, when the difference is not greater than the predetermined threshold, the control algorithm 200 proceeds to 214. At 214, the control algorithm 200 ends.

In addition to generating alerts based on the difference between the actual power consumption and the benchmark or predicted power consumption, the system controller 70 can also determine a trend over time and provide a user, via the communication device 72, with information regarding the trend. For example, the system controller 70 may predict a future date, based on the current trend, when the difference will be greater than a predetermined threshold. The difference between the actual power consumption and the benchmark or predicted power consumption can also be used to calculate a system or component health score. Additionally, while the control algorithm 200 is described with reference to the power consumption for the entire refrigeration system 10, additionally or alternatively, the system controller 70 could perform the control algorithm 200 for one or more components of the refrigeration system 10, including one or more of the compressor rack 14, the condensing unit 36, and/or the refrigeration cases 52.

Figure 3:
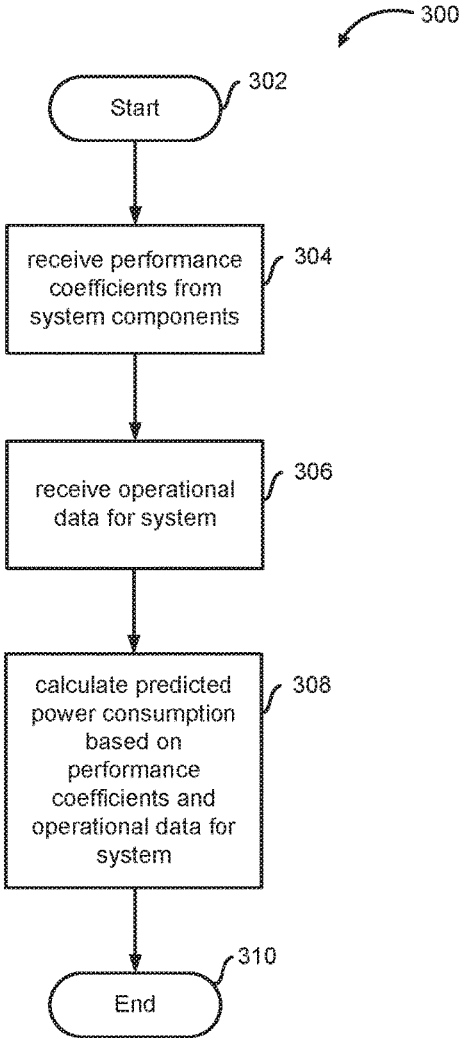
FIG. 3 is a flowchart of example operation in calculating predicted power consumption.

With reference to FIG. 3, a control algorithm 300 is shown for determining predicted power consumption based on performance coefficients for system components and operational data for the system. The functionality of FIG. 3, for example, is encapsulated at 206 of FIG. 2. The control algorithm 300 may be performed by the system controller 70 and starts at 302. At 304, the system controller 70 receives performance coefficient data for the system components of the refrigeration system 10. The performance coefficients are published by system component manufacturers and can be used to determine expected operational characteristics, including predicted power consumption, for a given system component, given particular operation conditions. For example, the compressor manufacturer may publish performance coefficients for a particular model of compressor. The system controller 70 may, for example, access a public database of performance coefficients at a system component manufacturer's website and determine the particular performance coefficients for the system components included in the refrigeration system. The performance coefficients may correspond to a particular model of the system component. Alternatively, the performance coefficients may be determined on a per-component basis at the time of manufacture. In such case, the performance coefficients may correspond to a particular model and serial number for the system component. For example, the system controller 70 may query the manufacturer's database with the particular model and serial number for the particular component to retrieve the performance coefficients. Additionally, the performance coefficients may be stored in a non-volatile memory on or with the system component itself. Alternatively, the performance coefficients may be received from a user via the communication device 72 or from the remote monitor 74 or communication device 76. After receiving the performance coefficients at 304, the system controller 70 proceeds to 306.

At 306, the system controller 70 receives operational data for the refrigeration system. For example, the operational data may include: discharge temperatures and/or pressures for the compressor rack 14; suction temperatures and/or pressures for the compressor rack 14; condensing temperature; condensing unit discharge temperature and/or pressure; evaporator temperatures and/or pressures; and/or outdoor ambient temperatures; etc. The operational data can be indicative of the load on the refrigeration system 10 and can be used, along with the performance coefficients, to determine predicted power consumption for the refrigeration system 10 for a particular load.

At 308, the system controller 70 calculates the predicted power consumption based on the performance coefficients for the system components and the operational data for the refrigeration system 10. At 310, the control algorithm 300 ends.

Figure 4:
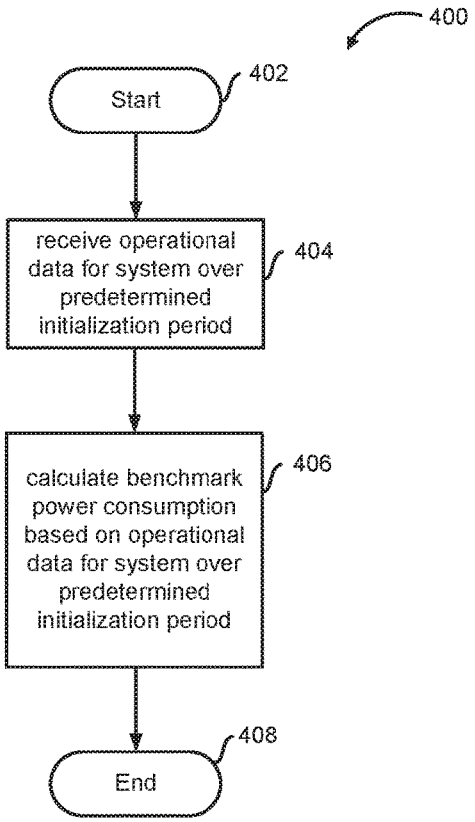
FIG. 4 is a flowchart of example operation in calculating benchmark power consumption.

With reference to FIG. 4, a control algorithm 400 is shown for determining benchmark power consumption based on system performance during a predetermined time period, such as an initialization period. The functionality of FIG. 4, for example, is encapsulated at 206 of FIG. 2. The control algorithm 400 may be performed by the system controller 70 and starts at 402. At 404, the system controller 70 receives operation data for the system during a predetermined initialization period. For example, the predetermined initialization period may be a time period, such as one or more weeks or months, just after the refrigeration system 10 is first installed or first repaired, or after maintenance is performed on the refrigeration system 10. The operational data may include: discharge temperatures and/or pressures for the compressor rack 14; suction temperatures and/or pressures for the compressor rack 14; condensing temperature; condensing unit discharge temperature and/or pressure; evaporator temperatures and/or pressures; and/or outdoor ambient temperatures; etc., as well as power consumption data for the refrigeration system components, such as the compressor rack 14, condensing unit 36, and refrigeration cases 52.

At 406, the system controller 70 calculates benchmark power consumption data based on the operational data for the system over the predetermined initialization period. In this way, the benchmark power consumption may be associated, for example, with the power consumed by the system after installation, maintenance, or repair. As discussed above, the actual power consumption can then be compared with the benchmark power consumption to determine whether refrigeration system performance has degraded and to what extent additional power is being consumed by the refrigeration system 10 due to deterioration. The control algorithm 400 ends at 408.

Systems and methods for calculating projected energy consumption data for a component of a refrigeration system based on ambient temperature data for comparison with actual energy consumption data are described in U.S. Pat. No. 8,065,886, which is incorporated herein by reference in its entirety.

Additionally, the monitored operational data can be used to calculate an overall coefficient of performance of the refrigeration system 10. For example, the system controller 70 may monitor suction pressure, discharge pressure suction temperature, discharge temperature, a liquid temperature, and power consumption data, and use thermophysical equations stored in the system controller 70 and the refrigerant type to determine the coefficient of performance and other performance characteristics of the refrigeration system 10. For example, the system controller 70 may determine capacity (kW), power input (kW), isentropic efficiency percentage, suction superheat temperature in degrees Celsius, discharge superheat temperature in degrees, superheat (K), subcooling (K), discharge temperature in degrees, and/or mass flow rate in kg/s.

Figure 5:
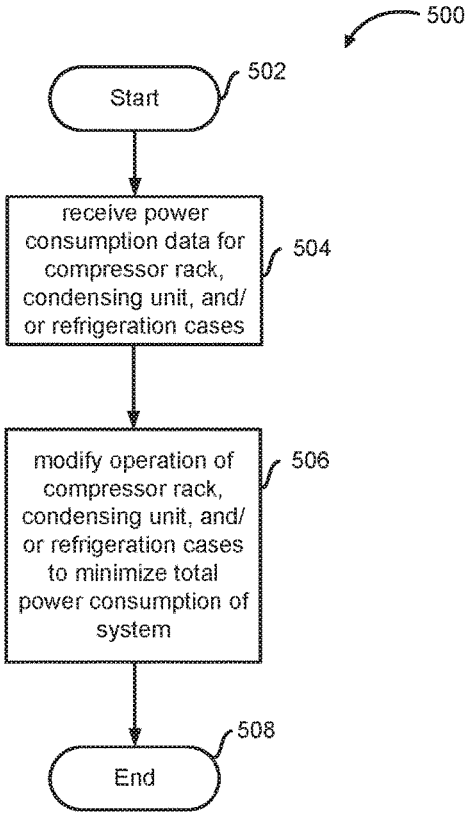
FIG. 5 is a flowchart of example operation in minimizing power consumption of a system.

With reference to FIG. 5, a control algorithm 500 is shown for optimizing total refrigeration system energy consumption. For example, the system controller 70 may modify the operation of individual system components and monitor how the modification affected overall power consumption of the refrigeration system 10. While a particular modification for operation of a particular component may result in an increase in power consumption for that component, it may cause a greater decrease in power consumption of another component, resulting in decreased power consumption of the refrigeration system 10 overall. For example, an increase in capacity of the condenser fan operation may result in increased power consumption by the condensing unit 36, but may result in decreased power consumption by the refrigeration cases 52 and/or compressor rack 14.

The control algorithm 500 may be performed by the system controller 70 and starts at 502. At 504, the system controller receives power consumption data for the compressor rack 14, condensing unit 36, and refrigeration cases 52. At 506, the system controller 70 modifies operation of at least one of the compressor rack, condensing unit, and/or the refrigeration cases to minimize the total power consumption of the system. For example, the system controller 70 may modify setpoints or capacities of the various system components and monitor the resulting effect on total power consumption for the refrigeration system 10. When the modification resulted in decreased total power consumption, the system controller 70 may make a similar modification to determine whether the similar modification likewise decreases total power consumption. When the modification does not result in decreased total power consumption, the system controller 70 may make the opposite modification and monitor the effect on total power consumption. The control algorithm 500 ends at 508.

Systems and methods for modulating a condenser set point to minimize energy consumption are described in U.S. Pat. No. 8,051,668, which is incorporated herein by reference in its entirety.

Figure 6:
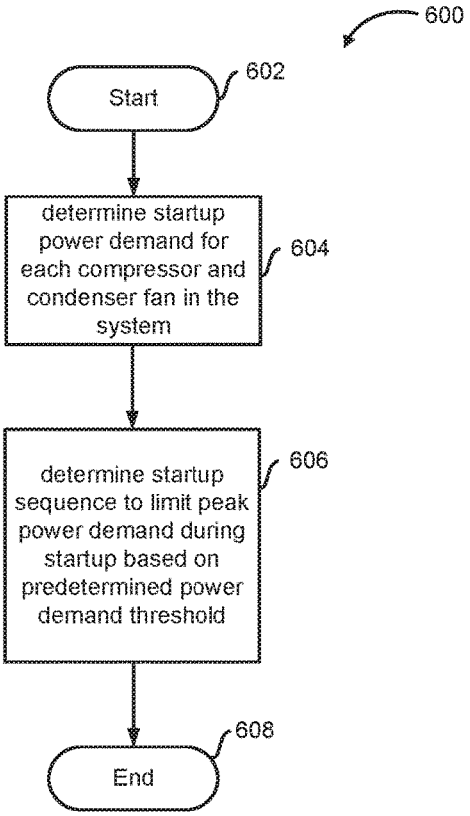
FIG. 6 is a flowchart of example operation in determining a startup sequence to limit peak power demand.

With reference to FIG. 6, a control algorithm 600 is shown for limiting peak power demand during startup operations. The control algorithm 600 may be performed by the system controller 70 and starts at 602. At 604, the system controller 70 determines the startup power demand for each compressor 12 and condenser fan 40 in the refrigeration system 10. At startup, each component may receive an inrush of current at startup, resulting in a spike in power demand during the startup. Once the component is operating normally, the power consumed by the component may level off. At 604, the system controller 70 may calculate the startup power demand for each compressor 12 and condenser fan 40 based on known characteristics of the component, such as the manufacturer's nameplate ratings, horsepower, capacity, etc. Alternatively or additionally, the system controller 70 may monitor power consumption of the component during startup operations and record the peak power demand.

At 606, the system controller 70 may determine a sequence and timing for starting components of the system, including the compressors 12 and condenser fans 40 to limit the total peak power demand during startup operations. For example, the system controller 70 may stagger the initiation of startup operations for the components over time. Additionally, the system controller 70 may opt to start a component with a high peak power demand at the same time as a component with a low peak power demand. The system controller 70 and/or the remote monitor 74 may calculate and report energy savings resulting from limiting the peak startup power demand and/or tie the results to a utility data model. The control algorithm ends at 608.

Figure 7:
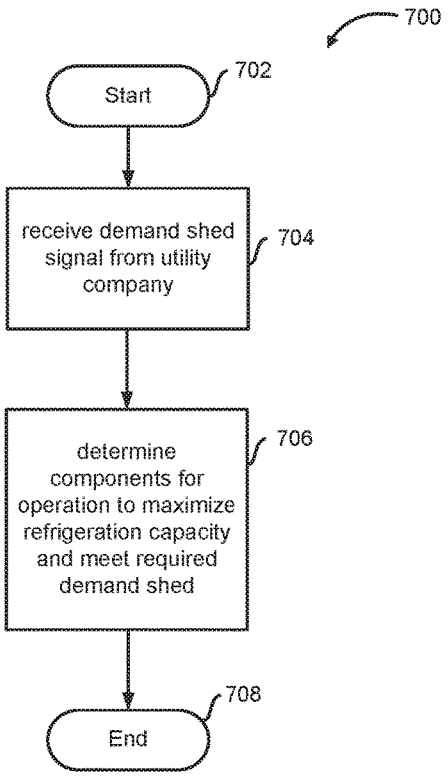
FIG. 7 is a flowchart of example operation in maximizing capacity while meeting a required demand shed.

With reference to FIG. 7, a control algorithm 700 is shown for providing demand shed functionality. The control algorithm 700 may be performed by the system controller 70 and starts at 702. At 704, the system controller 70 may receive a demand shed signal from a utility company. For example, at certain times the utility company may require utility users to reduce their overall power consumption to limit the total power being demanded from the utility.

At 706, the system controller 70 can determine a set of components that will maximize refrigeration capacity while meeting the demand shed requirement under the current operating conditions. For example, based on having monitored power consumption and capacity data for each component of the system, along with operational data indicative of system load, the system controller 70 can determine which subsets of compressors and condenser fans can operate together with a total power consumption that is less than the power demand shed requirement. From those possible subsets of compressor and condenser fan combinations, the system controller 70 can determine the particular combination that will maximize total refrigeration capacity, given the current operating conditions.

In addition, if onsite power generation is available, such as solar or wind power generation, the system controller 70 may receive an energy limiting signal from the onsite power generation device, such as a photovoltaic array. The system controller 70 can the coordinate the selection of components for operation to limit the current power demand to be below the power being generated by the onsite power generation device or below a predicted power to be generated by the onsite power generation device.

In addition, at 706 the system controller 70 can also modify existing defrost schedules and/or other operations, such as scheduled precooling operations, based on the onsite generation capacity and/or the demand shed signal.

Figure 8:
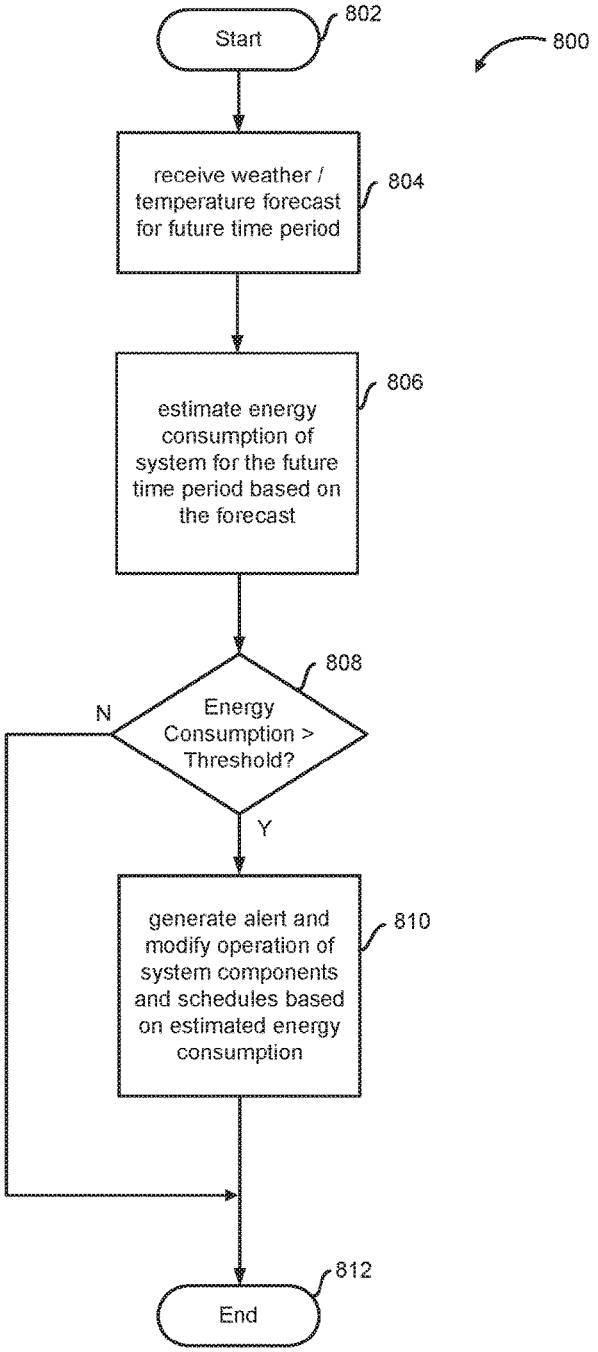
FIG. 8 is a flowchart of example operation in predicting energy consumption based on forecast data.

With reference to FIG. 8, a control algorithm 800 is shown for predicting energy required for a future time period and modifying system operation. The control algorithm 800 may be performed by the system controller 70 and starts at 802. At 804, the system controller 70 receives weather or temperature forecast data for a future time period. The system controller 70 may access a weather database or weather service website and/or receive weather forecast and temperature data from the remote monitor 74, the communication device, or the communication device 76. At 806, the system controller 70 estimates the predicted energy consumption for the system based on the indicated weather or temperature forecast data. For example, based on the forecast, the system controller 70 can predict the anticipated load on the refrigeration system 10 as well as the anticipated power consumption for the refrigeration system.

At 808, the system controller 70 determines whether the predicted energy consumption is greater than a predetermined threshold. At 808, when the predicted energy consumption is greater than the predetermined threshold, the system controller 70 proceeds to 810 and can send an alert to a user or operator of the refrigeration system 10 via the communication device 72, remote monitor 74, and/or communication device 76. Additionally, the system controller 70 can modify operation of the system components and schedules. For example, the system controller 70 may reschedule previously scheduled defrost operations. Additionally, the system controller 70 may implement precooling prior to the future time period. For example, the system controller 70 may increase capacity of the refrigeration system 10 prior to the future time period to decrease the temperature in particular refrigeration cases 52 prior to the future time period. In this way, the load on the refrigeration system 10 during the future time period may be decreased as compared with normal operation.

Additionally, the system controller 70 may receive real time pricing information and/or smart grid initiatives to determine a predicted energy cost for the future time period. Similarly, the system controller 70 may modify operation of the system components and schedules based on the predicted energy cost and/or smart grid initiatives.

At 808, when the predicted energy consumption is not greater than the predetermined threshold, the system controller 70 proceeds to 812. At 812, the control algorithm 800 ends.

Figure 9A:
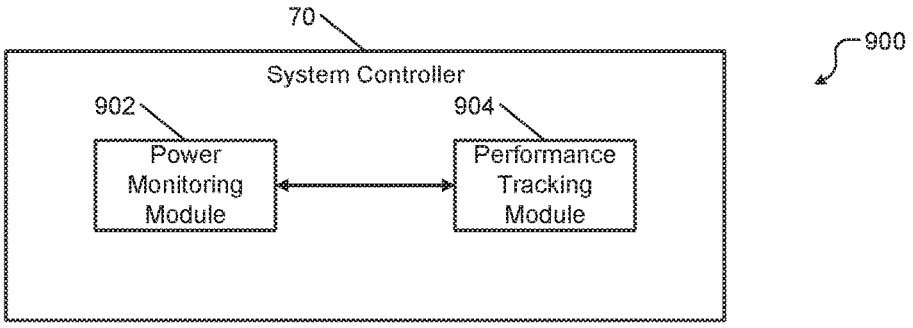
FIGS. 9A and 9B are block diagrams of an example system for monitoring power consumption of compressors of the refrigeration system of FIG. 1.
Figure 9B:
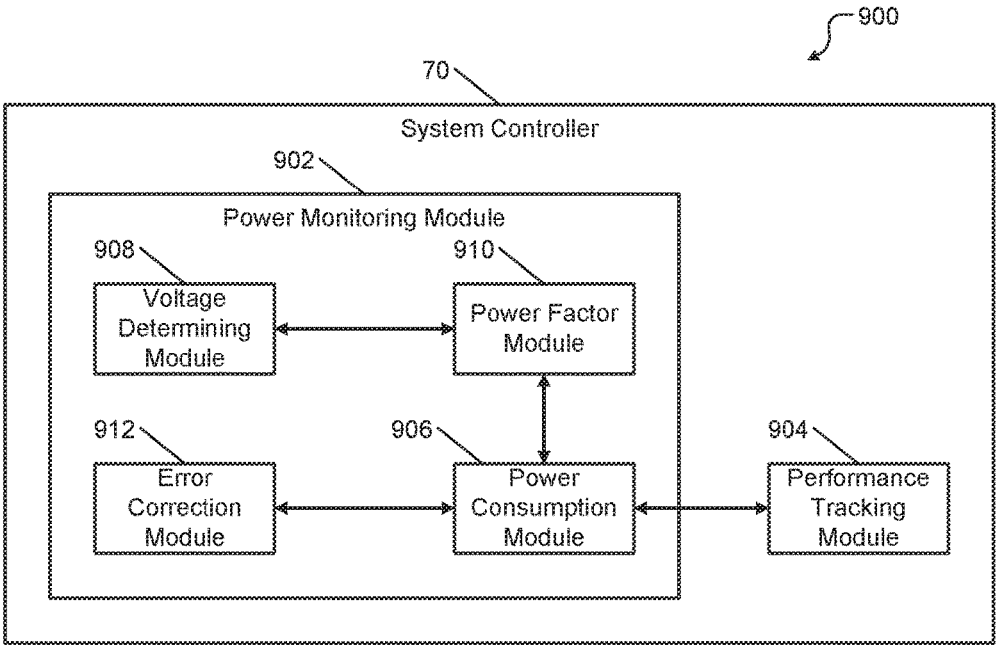
Figure 10:
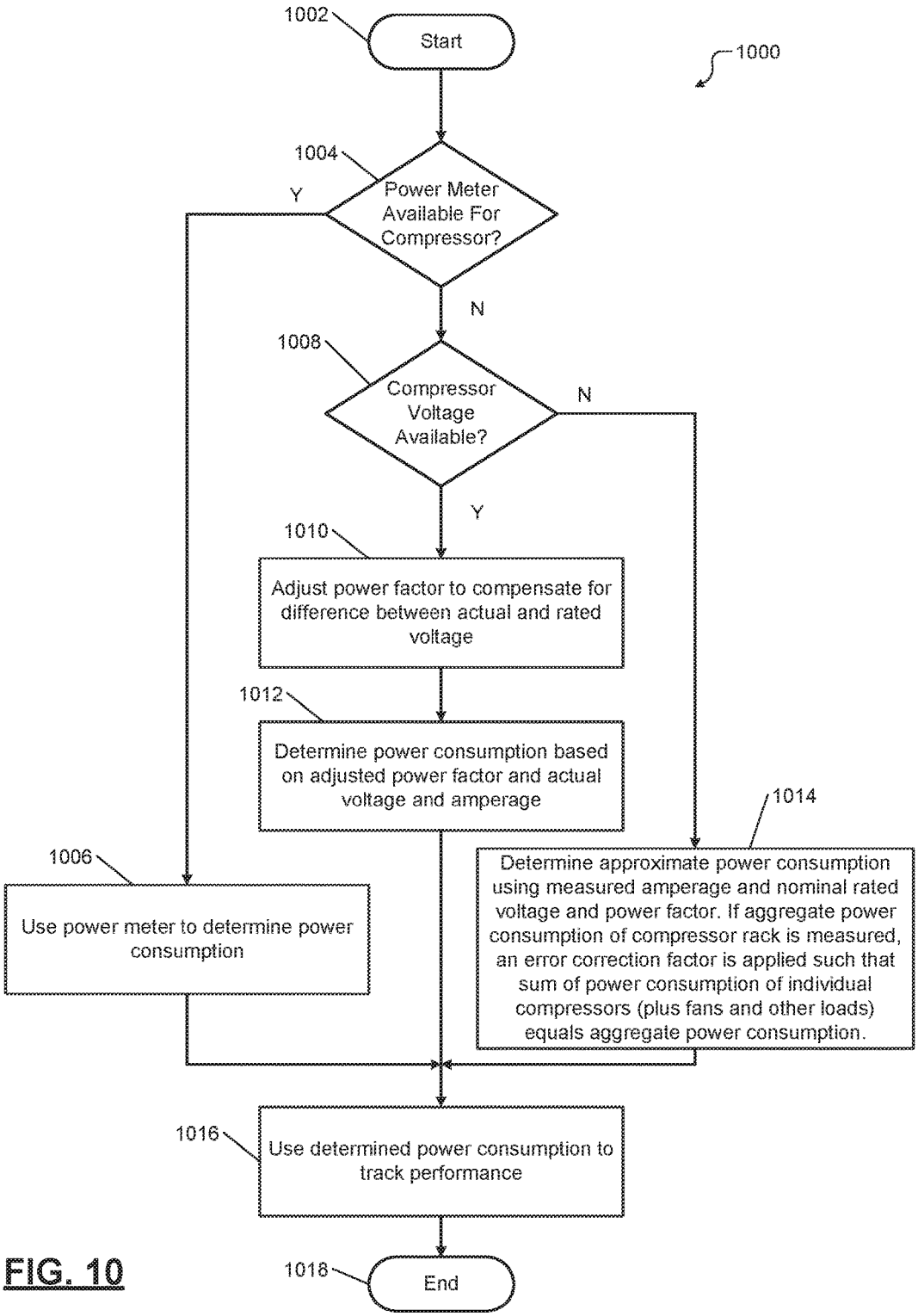
FIG. 10 is a flowchart of an example operation in monitoring power consumption of compressors of the refrigeration system of FIG. 1.
Figure 11:
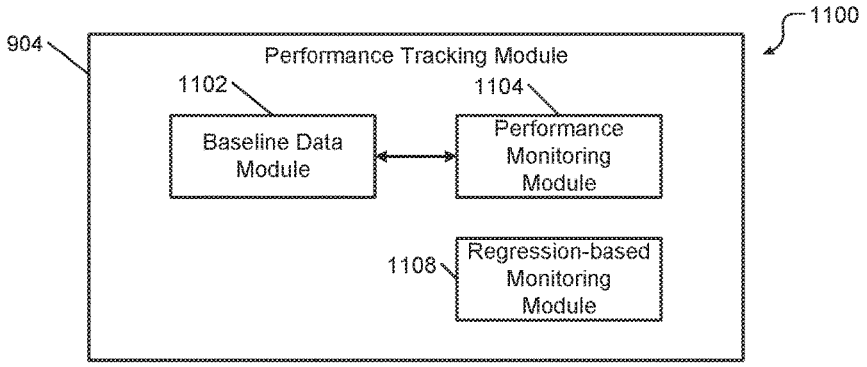
FIG. 11 is a block diagram of an example system for tracking performance of compressors of the refrigeration system of FIG. 1.
Figure 12:
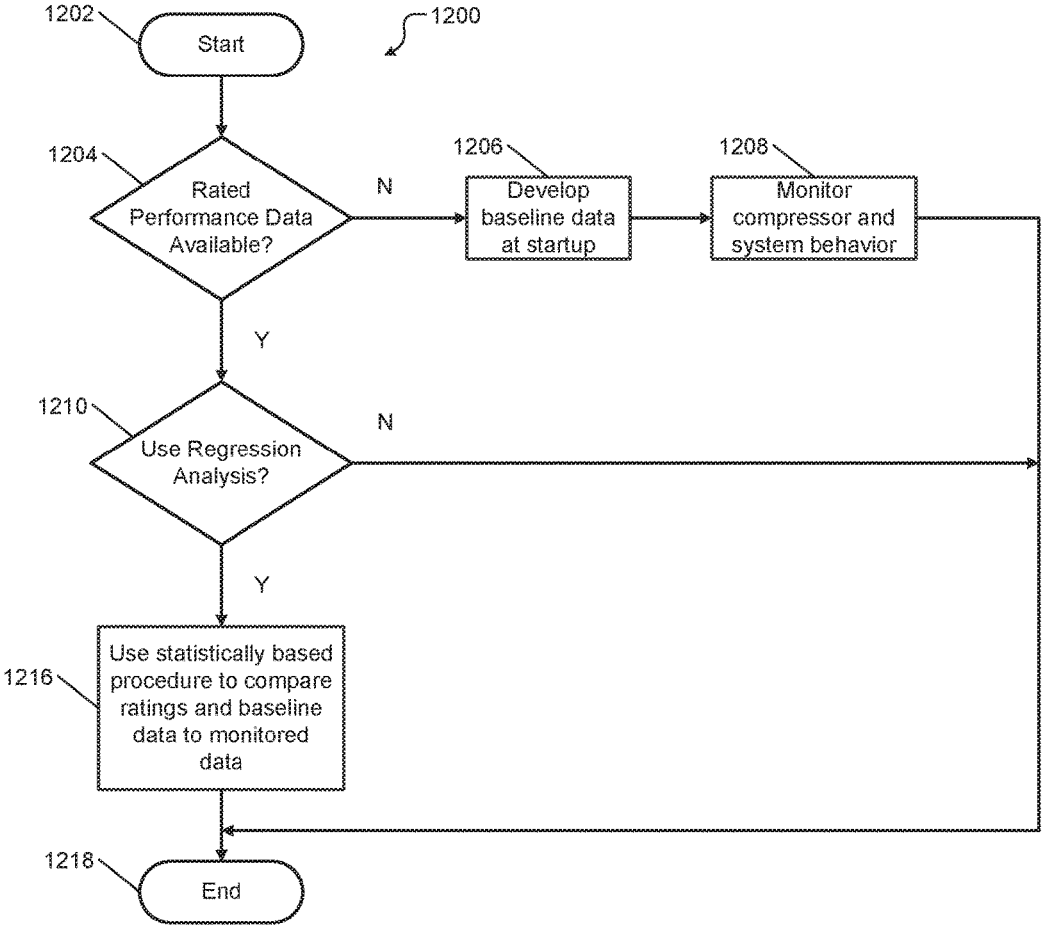
FIG. 12 is a flowchart of an example operation in tracking performance of compressors of the refrigeration system of FIG. 1.
Figure 13:
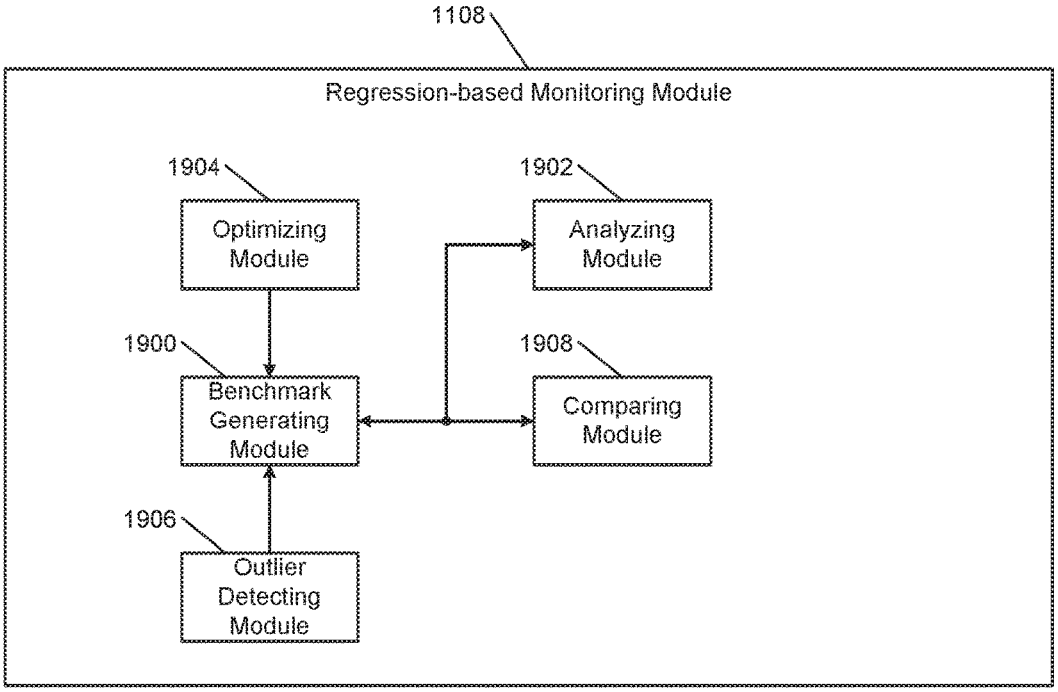
FIG. 13 is a block diagram of an example regression-based system for tracking performance of compressors of the refrigeration system of FIG. 1.
Figure 14:
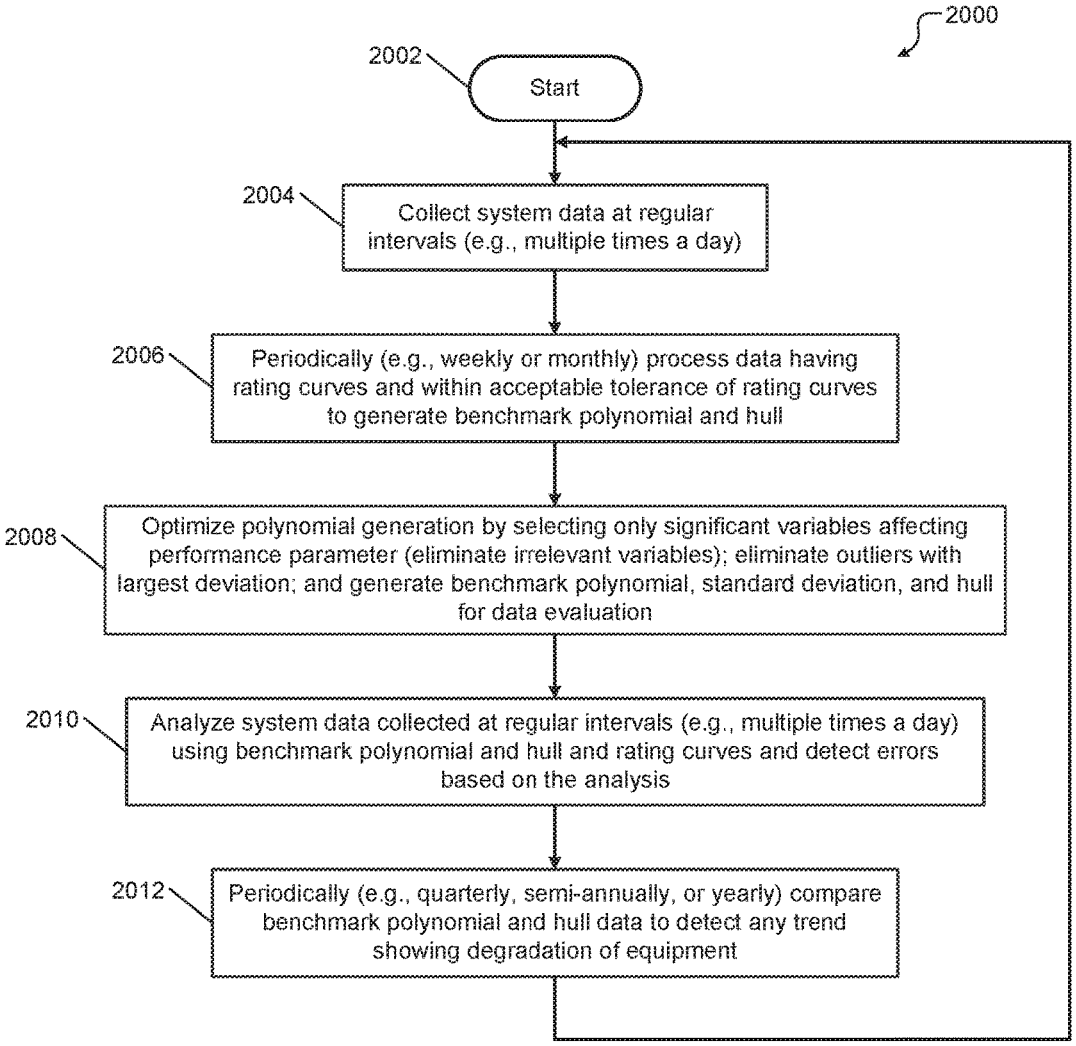
FIG. 14 is a flowchart of an example operation in regression-based performance tracking of compressors of the refrigeration system of FIG. 1.

The various aspects of the present disclosure described above are now described in further detail below. The disclosure below is organized as follows. FIGS. 9A, 9B, and 10 illustrate power monitoring of individual compressors 12 in the compressor rack 14 shown in FIG. 1. FIGS. 11 and 12 illustrate systems and methods for tracking performance of individual compressors 12. FIGS. 13 and 14 illustrate a system and method for regression-based monitoring of compressor performance.

With reference to FIGS. 9A and 9B, an example of a system 900 for monitoring power consumption of individual compressors 12 in the compressor rack 14 of FIG. 1 is shown. In FIG. 9A, the system 900 is implemented in the system controller 70 shown in FIG. 1. The system controller 70 includes a power monitoring module 902 and a performance tracking module 904. The power monitoring module 902 monitors the power consumption of individual compressors 12 in the compressor rack 14. The performance tracking module 904 tracks the performance of the individual compressors 12 based on the power consumption monitored by the power monitoring module 902. The performance tracking module 904 also diagnoses the health of the individual compressors 12 based on the power consumption monitored by the power monitoring module 902 and the performance tracked by the performance tracking module 904. Accordingly, the power monitoring and performance tracking can be used for both energy management and maintenance and diagnostics of the refrigeration system 10.

In FIG. 9B, an example of the power monitoring module 902 is shown. The power monitoring module 902 includes a power consumption module 906, a voltage determining module 908, a power factor module 910, and an error correction module 912. The power consumption module 906 determines the power consumption of each compressor 12 in different ways depending on the type of data available. For example, if each compressor 12 has a power meter associated with it, the power consumption module 906 determines the power consumption of each compressor 12 directly from the power consumption data received from the power meter associated with the respective compressor 12. If, however, a power meter is not available for each compressor 12, the power consumption module 906 determines the power consumption of each compressor 12 in one of two ways.

In a first way, the voltage determining module 908 determines a supply voltage available for each compressor 12 based on the power supplied to the compressor rack 14 by the power supply 32 (shown in FIG. 1) and a number of compressors 12 in the compressor rack 14. The power factor module 910 adjusts a power factor for a particular compressor 12 based on the supply voltage for the particular compressor 12 determined by the voltage determining module 908. The power factor for the particular compressor 12 changes due to changes in operating conditions (e.g., load) of the particular compressor 12 and changes in the supply voltage for the particular compressor 12. The power factor module 910 adjusts the power factor for the particular compressor 12 to compensate for differences between the actual supply voltage for the particular compressor 12 (e.g., 240V or 220V) and a voltage rating of the particular compressor 12 (e.g., 230V).

The power factor module 910 adjusts the power factor for the particular compressor 12 using the formula (or other PF correction formula applicable to the compressor) $PF=Volts_{rating}*PF_{rating}*(Amps_{nominal\text{-}rating}/Amps_{actual})/Volts_{actual}$, where $Volts_{rating}$ denotes the voltage rating of the particular compressor 12, $P\ F_{rating}$ denotes a power factor rating of the particular compressor 12, $Amps_{nominal\text{-}rating}$ denotes an amperage or a current rating of the particular compressor 12, $Amps_{actual}$ denotes an actual current consumption of the particular compressor 12, and $Volts_{actual}$ denotes the actual supply voltage for the particular compressor 12 determined by the voltage determining module 908.

The power consumption module 906 determines the power consumption of the particular compressor 12 based on the adjusted or corrected power factor determined by the power factor module 910. The power consumption module 906 determines the power consumption of the particular 3-phase (for example) compressor 12 using the formula Power=Volts*PF*amps*3^0.5, where Volts denotes the actual supply voltage for the particular compressor 12 determined by the voltage determining module 908, PF denotes the adjusted or corrected power factor determined by the power factor module 910, and amps denotes the actual amperage of the particular compressor 12.

In a second way, the error correction module 912 determines an error correction factor in the event that the supply voltage for the particular compressor 12 is unknown but the total power consumption of the compressor rack 14 is known (e.g., from the rack power sensor 34 shown in FIG. 1). The power consumption of each individual compressor 12 is calculated based on the actual amperage, rated voltage, and rated power factor of each compressor 12. The correction factor is applied to the individual power consumption values of each compressor 12 such that the sum of the power consumption values of the individual compressors (plus fans and other loads) equals the measured total power consumption of the compressor rack 14.

With reference to FIG. 10, an example of a control algorithm 1000 for monitoring power consumption of individual compressors 12 in the compressor rack 14 is shown. For example, the control algorithm 1000 may be performed by the system controller 70 shown in FIG. 1. The control algorithm 1000 starts at 1002. At 1004, the system controller 70 determines whether power consumption data for a particular compressor 12 is available from a power meter is associated with the particular compressor 12. If power consumption data is available from a power meter, the system controller 70 uses the power consumption data from the power meter to determine the power consumption of the particular compressor 12 at 1006.

If, however, power consumption data is unavailable from a power meter, at 1008, the system controller 70 determines whether a supply voltage for the particular compressor 12 is available. For example, the system controller 70 may determine the supply voltage for a particular compressor 12 based on the power supplied by the power supply 32 to the compressor rack 14 and the number of compressors 12 in the compressor rack 14 (see FIG. 1).

If the system controller 70 can determine the supply voltage for the particular compressor 12, at 1010, the system controller 70 adjusts or corrects a power factor for the particular compressor 12 based on the supply voltage to compensate for difference between the actual supply voltage for the particular compressor 12 and a voltage rating of the particular compressor 12. For example, the system controller 70 adjusts or corrects the power factor for the particular compressor 12 using the formula disclosed above in the description of the power factor module 910 with reference to FIGS. 9A and 9B. At 1012, the system controller 70 determines the power consumption of the particular compressor 12 based on the adjusted or corrected power factor and actual supply voltage and amperage of the particular compressor 12. For example, the system controller 70 determines the power consumption of the particular compressor 12 using the formula disclosed above in the description of the power consumption module 906 with reference to FIGS. 9A and 9B.

If the supply voltage for the particular compressor 12 is unavailable, at 1014, the system controller 70 estimates the power consumption of the particular compressor 12 using the amperage of the particular compressor 12 and the voltage rating and the rated power factor of the particular compressor 12. If a power meter (e.g., the rack power sensor 34 shown in FIG. 1) measures an aggregate power consumption of the compressor rack 14, an error correction factor is applied such that sum of power consumption of individual compressors (plus fans and other loads) equals aggregate power consumption.

At 1016, the system controller 70 uses the power consumption determined as described above to track the performance and diagnose the health of the particular compressor 12. The system controller 70 determines the power consumption of each of the compressors 12 and tracks the performance and diagnoses the health of each of the compressors 12 as described above. The control algorithm 1000 ends at 1018.

With reference to FIG. 11, an example of a system 1100 for tracking performance of the compressors 12 in the compressor rack 14 of FIG. 1 is shown. The system 1100 can be generally implemented in the system controller 70 shown in FIG. 1 and can be specifically implemented in the performance tracking module 904 shown in FIGS. 9A and 9B. The performance tracking module 904 determines whether the performance of the compressors 12 conforms to the manufacturer's rated performance. The performance tracking module 904 includes a baseline data module 1102, a performance monitoring module 1104, and a regression-based monitoring module (regression module) 1108. The operation of these modules is explained below in brief with reference to FIG. 12.

Briefly, if rated performance data for the compressor 12 is unavailable, the performance tracking module 904 generates baseline data for the compressor 12 and assesses the performance and diagnoses the health of the compressor 12 by comparing operational data of the compressor 12 to the baseline data for the compressor 12. If, however, the rated performance data for the compressor 12 is available, the performance tracking module 904 assesses the performance and diagnoses the health of the compressor 12 by comparing the operational data of the compressor 12 to the rated performance data for the compressor 12.

The baseline data module 1102 generates the baseline data for the compressor 12 based on data received from the compressor 12 immediately following installation of compressor 12. The performance monitoring module 1104 assesses the performance and diagnoses the health of the compressor 12 by comparing the baseline data to the operational data of the compressor 12 obtained subsequent to developing the baseline data for the compressor 12.

The regression-based monitoring module 1108 performs a regression analysis on the rated performance data and the data obtained from the compressor 12 during operation and assesses the performance and diagnoses the health of the compressor 12 based on the regression analysis.

With reference to FIG. 12, an example of a control algorithm 1200 for tracking performance of the compressors 12 and the compressor rack 14 of FIG. 1 is shown. For example, the control algorithm 1200 may be performed generally by the system controller 70 shown in FIG. 1 and specifically by the performance tracking module 904 shown in FIG. 11. The control algorithm 1200 is explained below in brief. A detailed description of the modules of FIG. 11 and the control algorithm 1200 follows thereafter.

The control algorithm 1200 starts at 1202. At 1204, the performance tracking module 904 determines whether rated performance data for the compressors 12 is available. If the rated performance data for the compressors 12 is unavailable, the baseline data module 1102 generates baseline data for each compressor 12 at startup following installation at 1206. At 1208, the performance monitoring module 1104 uses the baseline data generated by the baseline data module 1102 as reference and compares data obtained during operation with the baseline data to monitor and assess the performance and to diagnose the health of the compressor 12.

If, however, the rated performance data for the compressors 12 is available, at 1210, the performance tracking module 904 determines whether other methods including but not limited to regression-based analysis is used to monitor and assess the performance and diagnose the health of the compressor 12. If regression-based analysis is used, at 1216, the regression module 1108 uses statistically based procedures to compare ratings and baseline data to monitored data in order to assess compressor and system behavior and health. The control algorithm 1200 ends at 1218.

With reference to FIG. 13, an example of the regression-based monitoring module 1108 is shown in further detail. The regression-based monitoring module 1108 can monitor performance of compressor, condenser, evaporator, or any other system component for which performance data is available. Therefore, while the operation of the regression-based monitoring module 1108 is described below with reference to the compressor 12 for example only, the teachings of the present disclosure can also be applied to monitor the performance and diagnose health of other system components.

The regression-based monitoring module 1108 includes a benchmark generating module 1900, an analyzing module 1902, an optimizing module 1904, an outlier detecting module 1906, and a comparing module 1908. The operation of these modules is described below in detail with reference to FIG. 14.

Briefly, the regression-based monitoring module 1108 performs a regression analysis on the rated performance data and the data obtained from the compressor 12 during operation, and assesses the performance and diagnoses the health of the compressor 12 based on the regression analysis as follows. The benchmark generating module 1900 generates a benchmark polynomial and a benchmark hull. The analyzing module 1902 analyzes data obtained from the compressor 12 during operation using the benchmark polynomial and the benchmark hull and assesses the performance and diagnoses the health of the compressor 12 based on the analysis.

The optimizing module 1904 selects only statistically significant variables affecting a selected one of the rated performance data (e.g., power consumption of the compressor 12) and eliminates statistically insignificant variables that do not significantly affect the selected one of the rated performance data (e.g., power consumption of the compressor 12). The optimizing module 1904 optimizes the benchmark polynomial using the selected variables.

The outlier detecting module 1906 detects outliers in the data obtained from the compressor 12 during operation and removes outliers with largest deviation. The comparing module 1908 compares the benchmark polynomial and the benchmark hull with historical benchmark polynomial and hull data and assesses the performance and diagnoses the health of the compressor 12 based on the comparison.

In general, the regression-based monitoring module 1108 performs the following functions: data collecting and evaluation at regular intervals (e.g., multiple times a day), periodically (e.g., weekly or monthly) benchmarking and evaluation of data outside hull (explained below), and long-term evaluation (e.g., quarterly, semiannually, or yearly). The benchmarking function further includes creating a model, checking the model for validity, eliminating outliers, simplifying the model by eliminating irrelevant variables, and calculating Hull. These functions are explained below in detail.

With reference to FIG. 14, an example of a control algorithm 2000 for regression-based performance monitoring of individual compressors 12 in the compressor rack 14 is shown. For example, the control algorithm 2000 may be performed generally by the system controller 70 shown in FIG. 1, specifically by the performance tracking module 904 shown in FIG. 11, and more specifically by the regression-based monitoring module 1108 shown in FIG. 13. The control algorithm 2000 starts at 2002.

At 2004, the regression-based monitoring module 1108 collects system or compressor sensor data multiple times a day (e.g., every second, minute, hour). For example, the data may be for power consumption, mass flow rate, or any other parameter of any system component relevant for determining system performance and diagnosing system health trends.

At 2006, the benchmark generating module 1900 processes the data having rating curves and within acceptable tolerance of the rating curves. If the data is not within the acceptable tolerance of the rating curves an error or warning is generated. The data within the acceptable tolerance is stored and processed for generating benchmark polynomial and benchmark hull. Hull is a region of data points inside of which a regression formula such as a polynomial can be used for prediction. The benchmark generating module 1900 generates a model and checks the validity of the model using statistical methods.

At 2008, the optimizing module 1904 selects only statistically significant variables that affect the selected performance parameter (e.g., power consumption of the compressor 12) and eliminates statistically irrelevant variables to simplify the benchmark polynomial being generated. Additionally, the outlier detecting module 1906 detects any outliers in the data, determines whether the outliers are not noise, and removes the outliers with the largest deviation to further simplify the benchmark polynomial being generated. The outlier removal also improves the accuracy of the model. The outliers are stored in a database and are evaluated over the long-term to determine whether the outliers were caused in fact by a system problem. The optimizing module 1904 optimizes the benchmark polynomial based on the selected variables and the eliminated outliers. The optimizing module 1904 also calculates benchmark hull along with the benchmark polynomial for data evaluation.

At 2010, the analyzing module 1902 analyzes the system data being collected at regular intervals using the benchmark polynomial, the benchmark hull, and the rating curves, and detects errors based on the analysis. For example, the analyzing module 1902 compares the data to the benchmark polynomial and determines whether the data is within one or more (e.g., ±2) standard deviations of the benchmark polynomial. The analyzing module 1902 also determines whether the data is outside the benchmark hull. Further, the analyzing module 1902 determines whether the data is within an acceptable tolerance of the rating curves for the data. If the data is within the acceptable tolerance of the rating curves for the data, the data is stored and used for generating future benchmark polynomial and benchmark hull. If the data is not within the acceptable tolerance of the rating curves for the data, an error or warning regarding compressor performance and health is issued.

At 2012, the comparing module 1908 periodically (e.g., quarterly, semiannually, or yearly) compares the benchmarks to detect long-term trends, determines whether the long-term trends show any deterioration of the equipment, and issues an error or warning if the long-term trends show any deterioration of the equipment.

In summary, the systems and methods described above can perform energy management functions for refrigeration systems. Specifically, the systems and methods can track performance of individual compressors by comparing actual versus predicted parameters (e.g., power consumption). The systems and methods can optimize power consumption of the refrigeration system 10 by coordinating power consumption of the compressor rack 14 and other components of the refrigeration system 10 such as the condenser 38, for example. The systems and methods can limit peak power by using a smart startup algorithm. The systems and methods can provide demand shed capabilities. The systems and methods can predict energy required in view of future operating conditions.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A system comprising:

a system controller for a refrigeration or HVAC system having a compressor rack with a plurality of compressors and a condensing unit with a plurality of condenser fans, the system controller monitoring and controlling operation of the refrigeration or HVAC system;

a rack controller in communication with the system controller, the rack controller monitoring and controlling operation of the compressor rack; and a condensing unit controller in communication with the system controller, the condensing unit controller monitoring and controlling operation of the condensing unit;

wherein the system controller determines a startup power demand for each compressor of the plurality of compressors and each condenser fan of the plurality of condenser fans, monitors a total power demand of the compressor rack and the condensing unit, and limits peak power demand of the HVAC system during operation by controlling activation and deactivation of the plurality of compressors and the plurality of condenser fans, based on the monitored total power demand of the compressor rack and the condensing unit and the startup power demand for each compressor of the plurality of compressors and each condenser fan of the plurality of condenser fans, so that the total power demand is below a predetermined power threshold.

2. A method comprising:

monitoring and controlling, with a system controller, a refrigeration or HVAC system having a compressor rack with a plurality of compressors and a condensing unit with a plurality of condenser fans;

monitoring and controlling, with a rack controller in communication with the system controller, operation of the compressor rack;

monitoring and controlling, with a condensing unit controller in communication with the system controller, operation of the condensing unit;

determining, with the system controller, a startup power demand for each compressor of the plurality of compressors and each condenser fan of the plurality of condenser fans; and monitoring, with the system controller, a total power demand of the compressor rack and the condensing unit; and limiting, with the system controller, peak power demand of the HVAC system during operation by controlling activation and deactivation of the plurality of compressors and the plurality of condenser fans, based on the monitored total power demand of the compressor rack and the condensing unit and the startup power demand for each compressor of the plurality of compressors and each condenser fan of the plurality of condenser fans, so that the total power demand is below a predetermined power threshold.

3. A system comprising:

a system controller for a refrigeration or HVAC system having a compressor rack with a plurality of compressors and a condensing unit with a plurality of condenser fans, the system controller monitoring and controlling operation of the refrigeration or HVAC system;

a rack controller in communication with the system controller, the rack controller monitoring and controlling operation of the compressor rack; and a condensing unit controller in communication with the system controller, the condensing unit controller monitoring and controlling operation of the condensing unit;

wherein the system controller monitors a total power consumption of the compressor rack and the condensing unit, receives a signal corresponding to limiting power consumption, and selects at least one compressor from the plurality of compressors and at least one condenser fan from the plurality of condenser fans to operate to provide needed refrigeration capacity while maintaining the total power consumption below a power threshold associated with the signal.

4. The system of claim 3, wherein the signal is received from a utility as a demand shed signal and wherein the power threshold is associated with the demand shed signal.

5. The system of claim 3, wherein the signal is received from an onsite power generation device and wherein the power threshold corresponds to an amount of power generated by the onsite power generation device.

6. The system of claim 3, wherein the signal is received from an onsite power generation device and wherein the power threshold corresponds to a predicted amount of power to be generated by the onsite power generation device.

7. A method comprising:

monitoring and controlling, with a system controller, a refrigeration or HVAC system having a compressor rack with a plurality of compressors and a condensing unit with a plurality of condenser fans;

monitoring and controlling, with a rack controller in communication with the system controller, operation of the compressor rack;

monitoring and controlling, with a condensing unit controller in communication with the system controller, operation of the condensing unit;

monitoring, with the system controller, a total power consumption of the compressor rack and the condensing unit;

receiving, with the system controller, a signal corresponding to limiting power consumption; and selecting, with the system controller, at least one compressor from the plurality of compressors and at least one condenser fan from the plurality of condenser fans to operate to maximize refrigeration capacity while maintaining the total power consumption below a power threshold associated with the signal.

8. The method of claim 7, wherein the signal is received from a utility as a demand shed signal and wherein the power threshold is associated with the demand shed signal.

9. The method of claim 7, wherein the signal is received from an onsite power generation device and wherein the power threshold corresponds to an amount of power generated by the onsite power generation device.

10. The method of claim 7, wherein the signal is received from an on-site power generation device and wherein the power threshold corresponds to a predicted amount of power to be generated by the on-site power generation device.

11. A system comprising:

a system controller for a refrigeration or HVAC system having a compressor rack with at least one compressor and a condensing unit with at least one condenser fan, the system controller monitoring and controlling operation of the refrigeration or HVAC system;

a rack controller in communication with the system controller, the rack controller monitoring and controlling operation of the compressor rack and determining compressor rack power consumption data; and a condensing unit controller in communication with the system controller, the condensing unit controller monitoring and controlling operation of the condensing unit and determining condensing unit power consumption data;

wherein the system controller receives the compressor rack power consumption data and the condensing unit power consumption data, receives forecast weather data for a future time period, determines a predicted total power consumption of the refrigeration or HVAC system based on the forecast weather data, compares the predicted total power consumption of the refrigeration or HVAC system with a predetermined power threshold, and performs at least one of generating an alert and modifying operation of the refrigeration or HVAC system when the predicted total power consumption is greater than the predetermined power threshold.

12. The system of claim 11 wherein the system controller performs at least one of pre-cooling a refrigeration case and storing power in an energy storage device.

13. The system of claim 11 wherein the system controller modifies operation of the refrigeration or HVAC system prior to the future time period to reduce power consumption of the refrigeration or HVAC system during the future time period.

14. A method comprising:

monitoring and controlling, with a system controller, operation of a refrigeration or HVAC system having a compressor rack with at least one compressor and a condensing unit with at least one condenser fan;

monitoring and controlling, with a rack controller in communication with the system controller, operation of the compressor rack;

determining, with the rack controller, compressor rack power consumption data for the compressor rack;

monitoring and controlling, with a condensing unit controller in communication with the system controller, operation of the condensing unit;

determining, with the condensing unit controller, power consumption data for the condensing unit;

receiving, with the system controller, the compressor rack power consumption data and the condensing unit power consumption data;

receiving, with the system controller, forecast weather data for a future time period;

determining, with the system controller, a predicted total power consumption of the refrigeration or HVAC system based on the forecast weather data;

comparing, with the system controller, the predicted total power consumption of the refrigeration or HVAC system with a predetermined power threshold; and performing, with the system controller, at least one of generating an alert and modifying operation of the refrigeration or HVAC system when the predicted total power consumption is greater than the predetermined power threshold and modifying operation of the refrigeration or HVAC system.

15. The method of claim 14 wherein the modifying, with the system controller, operation of the refrigeration or HVAC system includes modifying operation of the refrigeration or HVAC system prior to the future time period to reduce power consumption of the refrigeration or HVAC system during the future time period.

16. The method of claim 15 wherein the system controller performs pre-cooling one or more refrigeration cases.

17. The method of claim 15 wherein the system controller performs modifying defrost schedules of refrigeration cases.

18. The method of claim 15 wherein the system controller performs storing power in an energy storage device.

19. A system comprising:

a system controller for a refrigeration or HVAC system having a compressor rack with a plurality of compressors and a condensing unit with a plurality of condenser fans, the system controller monitoring and controlling operation of the refrigeration or HVAC system;

a rack controller in communication with the system controller, the rack controller monitoring and controlling operation of the compressor rack; and a condensing unit controller in communication with the system controller, the condensing unit controller monitoring and controlling operation of the condensing unit;

wherein the system controller determines a startup power demand for each compressor of the plurality of compressors and each condenser fan of the plurality of condenser fans and determines a startup sequence, based on the determined startup power demand for each compressor of the plurality of compressors and each condenser fan of the plurality of condenser fans, to limit peak power demand during a startup operation to be below a predetermined power threshold.

20. A method comprising:

monitoring and controlling, with a system controller, a refrigeration or HVAC system having a compressor rack with a plurality of compressors and a condensing unit with a plurality of condenser fans;

monitoring and controlling, with a rack controller in communication with the system controller, operation of the compressor rack;

monitoring and controlling, with a condensing unit controller in communication with the system controller, operation of the condensing unit;

determining, with the system controller, a startup power demand for each compressor of the plurality of compressors and each condenser fan of the plurality of condenser fans; and determining, with the system controller, a startup sequence, based on the determined startup power demand for each compressor of the plurality of compressors and each condenser fan of the plurality of condenser fans, to limit peak power demand during a startup operation to be below a predetermined power threshold.

* * * * *